US007802447B2

(12) United States Patent
Kumakura et al.

(10) Patent No.: US 7,802,447 B2
(45) Date of Patent: Sep. 28, 2010

(54) POSITIVE DISPLACEMENT EXPANDER

(75) Inventors: Eiji Kumakura, Osaka (JP); Masakazu Okamoto, Osaka (JP); Tetsuya Okamoto, Osaka (JP); Katsumi Sakitani, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 621 days.

(21) Appl. No.: 11/664,302

(22) PCT Filed: Sep. 30, 2005

(86) PCT No.: PCT/JP2005/018141

§ 371 (c)(1),
(2), (4) Date: Mar. 29, 2007

(87) PCT Pub. No.: WO2006/035935

PCT Pub. Date: Apr. 6, 2006

(65) Prior Publication Data

US 2009/0178433 A1 Jul. 16, 2009

(30) Foreign Application Priority Data

Sep. 30, 2004 (JP) ..... 2004-286880

(51) Int. Cl.
*F25B 41/06* (2006.01)
*F16L 55/04* (2006.01)

(52) U.S. Cl. ..... 62/527; 138/30

(58) Field of Classification Search ..... 62/402, 62/527, 189, 204, 205, 206, 222, 310, 86, 62/87, 401, 498; 138/30
See application file for complete search history.

(56) References Cited

U.S. PATENT DOCUMENTS 4,763,688 A * 8/1988 Morris ..... 137/509
6,312,232 B1 11/2001 Mori et al.

FOREIGN PATENT DOCUMENTS

| | | | | |
|---|---|---|---|---|
| CN | 1088803 | C | | 8/2002 |
| JP | 6-307401 | A | | 11/1994 |
| JP | 10-54215 | A | | 2/1998 |
| JP | 2003-4322 | A | | 8/2003 |
| JP | 2004-044569 | | * | 2/2004 |
| JP | 2004-190938 | A | | 7/2004 |
| JP | 2004190938 | A | * | 7/2004 |
| JP | 2004197640 | A | * | 7/2004 |

* cited by examiner

*Primary Examiner*—Frantz F Jules
*Assistant Examiner*—Emmanuel Duke
(74) *Attorney, Agent, or Firm*—Birch, Stewart, Kolasch & Birch, LLP.

(57) ABSTRACT

A casing (31) houses therein an expansion mechanism (60) and a compression mechanism (50). The expansion mechanism (60) has a rear head (62) in which a pressure snubbing chamber (71) is provided. The pressure snubbing chamber (71) is divided by a piston (77) into an inflow/outflow chamber (72) which fluidly communicates with an inflow port (34) and a back pressure chamber (73) which fluidly communicates with the inside of the casing (31). The piston (77) is displaced in response to suction pressure variation whereby the volume of the inflow/outflow chamber (72) varies. This enables the inflow/outflow chamber (72) to directly perform supply of refrigerant to or suction of refrigerant from the inflow port (34) which is a source of pressure variation, thereby making it possible to effectively inhibit suction pressure variation.

7 Claims, 15 Drawing Sheets

POSITIVE DISPLACEMENT EXPANDER

TECHNICAL FIELD

The present invention relates to a positive displacement expander, and concerns in particular measures for pressure pulsation reduction.

BACKGROUND ART

A positive displacement expander of the type which generates power by the expansion of high pressure fluid is known in the conventional technology (see, for example, JP-A-2004-190938). This type of positive displacement expander is employed, for example, in a refrigeration apparatus configured to perform a vapor compression refrigeration cycle.

Such a refrigeration apparatus includes a refrigerant circuit in which a compressor, a cooler, a positive displacement expander, and an evaporator are connected by piping, and the refrigerant circuit performs a vapor compression refrigeration cycle. In the positive displacement expander, sucked-in high pressure refrigerant is discharged after expansion and the resulting internal energy is converted into power for rotating the compressor.

Incidentally, the suction flow rate of the positive displacement expander during the suction process and the discharge flow rate of the positive displacement expander during the discharge process are not constant, and refrigerant pressure pulsation (pressure variation) occurs at the inlet and outlet sides and pressure loss is caused due to the pressure pulsation. To cope with this, the refrigeration apparatus is equipped with an accumulator at either the inlet or the outlet side of the positive displacement expander for the purpose of pressure pulsation inhibition. In addition, such a pressure pulsation triggers pressure loss and vibration in the equipment.

PROBLEMS THAT THE INVENTION INTENDS TO SOLVE

However, the problem with the above-described conventional refrigeration apparatus is that the apparatus grows in size because the accumulator is large in size. Another problem is that, since the accumulator is placed outside the positive displacement expander, pressure pulsation cannot effectively be inhibited. In other words, although pressure pulsation occurs, in fact, at the suction and discharge parts of the expansion chamber in the expander, the accumulator is positioned away from these pressure pulsation sources. As a result, the effect of inhibitive force falls and, besides, the property of response deteriorates.

The present invention has been made with the above problems in mind. Accordingly, an object of the present invention is to effectively inhibit pressure pulsation from occurring in the expander to thereby reduce, without fail, pressure loss and vibration while preventing the apparatus from growing in size.

DISCLOSURE OF THE INVENTION

The present invention provides, as problem solving means, the following aspects.

The present invention provides, as a first aspect, a positive displacement expander having within a casing (31) an expansion mechanism (60) for generating power by the expansion of fluid in an expansion chamber (65).

In the positive displacement expander of the first aspect, the casing (31) further contains therein a pressure snubbing means (79) for inhibiting at least either variation in the pressure of fluid which is drawn into the expansion chamber (65) or variation in the pressure of fluid which is discharged out of the expansion chamber (65).

In the first aspect of the present invention, variation in the pressure of suction fluid or discharge fluid (pressure pulsation), generated in the expansion mechanism (60) of the positive displacement expander used, for example, in the refrigerant circuit of a refrigeration apparatus, is inhibited by the pressure snubbing means (70).

In addition, the pressure snubbing means (70) is provided within the casing (31) whereby a reduced installation space is provided, and the refrigeration apparatus is downsized in comparison with the conventional arrangement in which the accumulator as a pressure variation inhibiting means is placed outside the casing. Furthermore, the pressure snubbing means (70) is provided within the casing (31), in other words, the pressure snubbing means (70) lies in close proximity to the suction and discharge parts of the expansion mechanism (60) which are sources of pressure pulsation.

Accordingly, the action of inhibition against pressure variation is exhibited more effectively than is possible in the prior art and, in addition, the property of response of the inhibitive action is expedited. Therefore, pressure variation is reduced more effectively. Consequently, not only equipment vibration but also pressure loss caused by pressure variation is reduced effectively.

The present invention further provides, as a second aspect according to the first aspect, a positive displacement expander in which the expansion mechanism (60) is provided with a suction passageway (34) for introducing fluid into the expansion chamber (65) and a discharge passageway (35) for discharging fluid after expansion from the expansion chamber (65).

In the positive displacement expander of the second aspect, the pressure snubbing means (70) is provided with a pressure snubbing chamber (71) which is so configured as to perform, in response to fluid pressure variation, suction of fluid from and discharge of fluid into either the suction passageway (34) or the discharge passageway (35).

In the second aspect of the present invention, variation in the pressure of suction fluid is caused in the suction passageway (34) and variation in the pressure of discharge fluid is caused in the discharge passageway (35). To cope with this, the pressure snubbing chamber (71) discharges fluid to the suction passageway (34), for example, when the pressure of suction fluid in the suction passageway (34) decreases. By means of this, the drop in the pressure of fluid in the suction passageway (34) is inhibited. Stated another way, the pressure snubbing chamber (71) provides a supply of pressure to the suction passageway (34). On the other hand, when the pressure of suction fluid in the suction passageway (34) increases, the pressure snubbing chamber (71) draws fluid from the suction passageway (34). By means of this, the rise in the pressure of fluid in the suction passageway (34) is inhibited. That is to say, the pressure snubbing chamber (71) performs suction of pressure from the suction passageway (34).

As described above, since the pressure snubbing chamber (71) performs discharge of fluid into or suction of fluid from the suction passageway (34) which is a source of pressure variation, this expedites response to pressure variation and effectively inhibits pressure variation. In addition, also with respect to variation in the pressure of discharge fluid in the discharge passageway (35), the same action is carried out.

In addition, the present invention provides, as a third aspect according to the second aspect, a positive displacement expander in which the pressure snubbing chamber (71) of the pressure snubbing means (70) is formed within a forming member (61, 62) of the expansion chamber (65).

In the third aspect of the present invention, for example, in the case where the expansion mechanism (60) is formed by a rotary expander, the pressure snubbing chamber (71) is defined within either a rear head (62) or a front head (61) which is the forming member (61, 62) of the expansion chamber (65), as shown in FIGS. 4 and 11. By means of this, the pressure snubbing chamber (71) is arranged in close proximity to either the suction passageway (34) or the discharge passageway (35), thereby ensuring that pressure variation is effectively inhibited.

In addition, the pressure snubbing chamber (71) is formed within the forming member (61, 62) which is an existing member. This arrangement obviates the need to provide a separate space in which to form the pressure snubbing chamber (71), thereby preventing the apparatus from growing in size.

The present invention still further provides, as a fourth aspect according to the second aspect, a positive displacement expander in which the pressure snubbing chamber (71) of the pressure snubbing means (70) is formed within an attachment member (83) supported by a forming member (61, 62) of the expansion chamber (65).

In the fourth aspect of the present invention, for example, in the case where the expansion mechanism (60) is formed by a rotary expander, the pressure snubbing chamber (71) is defined within the attachment member (83) attached to the end surface of either a rear head (62) or a front head (61) which is the forming member (61, 62) of the expansion chamber (65), as shown in FIG. 11. That is to say, the attachment member (83) in which the pressure snubbing chamber (71) is formed is mounted to the existing expansion mechanism (60) by making utilization of a space within the casing (31). Therefore, pressure pulsation in the expansion mechanism (60) is easily and effectively inhibited, just by additional attachment of the attachment member (83), especially to the existing positive displacement expander.

The present invention further provides, as a fifth aspect according to either the third aspect or the fourth aspect, a positive displacement expander in which a fluid compression mechanism (50) is provided within the casing (31) and an internal space (S) of the casing (31) is filled up with fluid compressed by the compression mechanism (50).

In the positive displacement expander of the fifth aspect, the pressure snubbing chamber (71) comprises (i) a fluid inflow/outflow chamber (72) in fluid communication with either the suction passageway (34) or the discharge passageway (35), (ii) a back pressure chamber (73) in fluid communication with the internal space (S) of the casing (31), and (iii) a partitioning member (77) which separates the inflow/outflow chamber (72) and the back pressure chamber (73) and which is displaceably configured such that the volume of the inflow/outflow chamber (72) varies in response to fluid pressure variation.

In the fifth aspect of the present invention, the internal space (S) of the casing (31) is placed in a high pressure state by discharge fluid from the compression mechanism (50). In other words, the casing (31) constitutes a so-called pressure vessel. Since the inflow/outflow chamber (72) is in fluid communication with either the suction passageway (34) or the discharge passageway (35), the inflow/outflow chamber (72) is placed in the same pressure state as the pressure state of suction or discharge fluid. On the other hand, since the back pressure chamber (73) is in fluid communication with the internal space (S) of the casing (31), the back pressure chamber (73) is held at the same high pressure state as the fluid discharged from the compression mechanism (50). And, in the normal condition, the inflow/outflow chamber (72) and the back pressure chamber (73) are balanced to each other in pressure through the partitioning member (77) in the pressure snubbing chamber (71).

Here, for example, if the pressure of suction fluid varies, the partitioning member (77) displaces, thereby causing the volume of the inflow/outflow chamber (72) to vary. Because of this volume variation, the inflow/outflow chamber (72) performs discharge of fluid into or suction of fluid from the suction passageway (34), so that the suction fluid is effectively inhibited from undergoing pressure variation.

To sum up, for example, when three is a decrease in the pressure of the suction fluid, the pressure of the inflow/outflow chamber (72) accordingly decreases, and the pressure of the inflow/outflow chamber (72) falls below the pressure of the back pressure chamber (73). In other words, there is created a difference in pressure between the inflow/outflow chamber (72) and the back pressure chamber (73). Because of this pressure difference, the partitioning member (77) displaces so that the volume of the inflow/outflow chamber (72) decreases, and a corresponding amount of fluid to the decreased volume is discharged to the suction passageway (34) from the inflow/outflow chamber (72). As a result of this, the drop in the pressure of suction fluid is reduced.

In addition, when the pressure of the suction fluid increases, the pressure of the inflow/outflow chamber (72) accordingly increases, and the pressure of the inflow/outflow chamber (72) exceeds the pressure of the back pressure chamber (73). Consequently, the partitioning member (77) displaces so that the volume of the inflow/outflow chamber (72) increases, and a corresponding amount of fluid to the increased volume is drawn into the inflow/outflow chamber (72) from the suction passageway (34). As a result of this, the rise in the pressure of suction fluid is reduced. The same action is performed, also when the pressure of the discharge fluid varies.

As described above, the discharge pressure of the compression mechanism (50) provided within the same casing (31) is used as a back pressure against the pressure of suction or discharge fluid, whereby pressure variation is effectively inhibited by an inexpensive and simple configuration as compared to the case when using an accumulator which is rather expensive and heavily equipped.

In addition, the present invention provides, as a sixth aspect according to either the third aspect or the fourth aspect, a positive displacement expander in which the pressure snubbing chamber (71) comprises (i) a fluid inflow/outflow chamber (72) in fluid communication with either the suction passageway (34) or the discharge passageway (35), (ii) a back pressure chamber (73) which is connected to either the suction passageway (34) or the discharge passageway (35) by a connecting pipe (81) having a capillary tube (82), and (iii) a partitioning member (77) which separates the inflow/outflow chamber (72) and the back pressure chamber (73) and which is displaceably configured such that the volume of the inflow/outflow chamber (72) varies in response to fluid pressure variation.

In the sixth aspect of the present invention, the inflow/outflow chamber (72) enters the same pressure state as the pressure state of either suction fluid or discharge fluid, as in the fifth aspect of the present invention. On the other hand, the back pressure chamber (73) is in fluid communication with either the suction passageway (34) or the discharge passageway (35) through the connecting pipe (81) having the capillary tube (82), so that the back pressure chamber (73) is placed in a lower pressure state, in other word; the pressure level of the back pressure chamber (73) is lower than that of either suction fluid or discharge fluid by an amount corresponding to the frictional resistance of the capillary tube (82). And, in the normal condition, there is established a balanced state between the pressure of the inflow/outflow chamber (72), the pressure of the back pressure chamber (73), and the frictional resistance force of the capillary tube (82) through the partitioning member (77) in the pressure snubbing chamber (71).

Here, if the pressure of suction fluid varies, the partitioning member (77) displaces, thereby causing the volume of the inflow/outflow chamber (72) to vary. Because of this volume variation, the inflow/outflow chamber (72) mainly performs discharge of fluid into or suction of fluid from the suction passageway (34), and the suction fluid is effectively inhibited from undergoing pressure variation.

To sum up, for example, when there is a decrease in the pressure of the suction fluid, the pressure of the inflow/outflow chamber (72) falls much below the pressure of the back pressure chamber (73) by the frictional resistance of the capillary tube (82), and the balanced state between the chambers (72, 73) is broken. As a result of this, the partitioning member (77) displaces so that the volume of the inflow/outflow chamber (72) decreases, and a corresponding amount of fluid to the decreased volume is discharged to the suction passageway (34) from the inflow/outflow chamber (72). Consequently, the drop in the pressure of suction fluid is reduced. At that time, although the volume of the back pressure chamber (73) increases, suction fluid in the suction passageway (34) little flows into the back pressure chamber (73) because of the intervention of the capillary tube (82), and the pressure of the back pressure chamber (73) decreases to approach the balanced state.

In addition, when there is an increase in the pressure of the suction fluid, the pressure of the inflow/outflow chamber (72) increases much above the pressure of the back pressure chamber (73) by the frictional resistance of the capillary tube (82), and the balanced state between the chambers (72, 73) is broken. As a result of this, the partitioning member (77) displaces so that the volume of the inflow/outflow chamber (72) increases, and a corresponding amount of fluid to the increased volume is drawn into the inflow/outflow chamber (72) from the suction passageway (34). Consequently, the rise in the pressure of suction fluid is reduced. At that time, although the volume of the back pressure chamber (73) decreases, suction fluid in the back pressure chamber (73) little flows into the suction passageway (34) because of the intervention of the capillary tube (82), and the pressure of the back pressure chamber (73) increases to approach the balanced state.

As described above, either fluid in the suction passageway (34) or fluid in the discharge passageway (35) is used as a back pressure, whereby pressure variation is effectively inhibited by an inexpensive and simple configuration, as in the fifth aspect of the present invention.

In addition, the present invention provides, as a seventh aspect according to either the fifth aspect or the sixth aspect, a positive displacement expander in which the positive displacement expander is used in a refrigerant circuit (20) in which refrigerant is circulated whereby a vapor compression refrigeration cycle is performed.

In the seventh aspect of the present invention, the positive displacement expander is used in the refrigerant circuit (20) of the air conditioner or the like. The expansion mechanism (60) performs an expansion stroke of the vapor compression refrigeration cycle in which high pressure refrigerant drawn into the expansion chamber (65) is discharged after expansion. Accordingly, variation in the pressure of suction or discharge refrigerant in the expansion mechanism (60) is inhibited effectively.

In addition, the present invention provides, as an eighth aspect according to the seventh aspect, a positive displacement expander in which the refrigerant is carbon dioxide.

In the eighth aspect of the present invention, carbon dioxide is used as a refrigerant circulating in the refrigerant circuit (20), thereby making it possible to provide earth-conscious equipment and apparatuses. Especially, for the case of carbon oxide, the same is compressed to its critical pressure state and its pressure variation correspondingly increases, but this pressure variation is effectively inhibited without fail.

ADVANTAGEOUS EFFECTS

In accordance with the first aspect of the present invention, the pressure snubbing means (70) for inhibiting variation in the pressure of at least either suction fluid or discharge fluid in the expansion mechanism (60) is provided within the casing (31), whereby the pressure snubbing means (70) is allowed to exercise its inhibitive force at the position extremely close to the suction and discharge parts of the expansion mechanism (60) which are sources of pressure variation. Accordingly, the action of inhibition against pressure variation is exhibited more effectively than is possible in the prior art and the property of response of the inhibitive action is expedited. Therefore, variation in the pressure of suction fluid is inhibited more effectively. Accordingly, the equipment is reduced effectively in vibration and pressure loss due to pressure variation and, in addition, it becomes possible to improve the equipment in reliability and operating efficiency.

Especially, in accordance with the second aspect of the present invention, the pressure snubbing chamber (71) performs suction of refrigerant from and discharge of refrigerant into either the suction passageway (34) or the discharge passageway (35) which is a source of pressure variation, whereby pressure variation is inhibited. As a result of this arrangement, the action of inhibition is worked further effectively and the property of response is improved to a further extent.

Furthermore, in accordance with the third aspect of the present invention, the pressure snubbing chamber (71) is provided within the forming member (61, 62) such as the rear and front heads of the expansion mechanism (60). As a result of this arrangement, not only inhibitive force can positively be exerted from the position near to either the suction passageway (34) or the discharge passageway (35), but it is also possible to prevent the equipment from growing in size because there is no need to secure a separate installation space in which to form the pressure snubbing chamber (71).

In addition, in accordance with the fourth aspect of the present invention, the attachment member (83) in which the pressure snubbing chamber (71) is formed is mounted to the expansion mechanism (60) by making utilization of a space within the casing (31). Therefore, pressure pulsation in the expansion mechanism (60) is easily and effectively inhibited, just by additional attachment of the attachment member (83), especially to an existing positive displacement expander.

In addition, in accordance with the fifth aspect of the present invention, the pressure snubbing chamber (71) is divided by the partitioning member (77) into the inflow/outflow chamber (72) in fluid communication with the suction passageway (34) and the back pressure chamber (73). The partitioning member (77) displaces in response to pressure variation to thereby cause the inflow/outflow chamber (72) to vary in volume. As a result of such arrangement, it becomes possible to positively perform discharge of refrigerant into either the suction passageway (34) or the discharge passageway (35) from the inflow/outflow chamber (72) and suction of refrigerant into the inflow/outflow chamber (72) from either the suction passageway (34) or the discharge passageway (35). By means of this, pressure variation is positively and effectively inhibited.

Especially, in the fifth aspect of the present invention, the back pressure chamber (73) is brought into fluid communication with the internal space (S) of the casing (31) filled up with the compression mechanism's (50) discharge pressure, whereby the discharge pressure of the compression mechanism (50) can be used as a back pressure. Accordingly, there is no need to provide a separate back pressure means and pressure variation is effectively inhibited by an inexpensive and simple configuration as compared to the case when using an accumulator which is rather expensive and heavily equipped.

In addition, in accordance with the sixth aspect of the present invention, the back pressure chamber (73) is brought into fluid communication with either the suction passageway (34) or the discharge passageway (35) by the connecting pipe (81) having the capillary tube (82), to thereby make utilization of its fluid pressure. Accordingly, there is no need to provide a separate back pressure means and pressure variation is effectively inhibited by an inexpensive and simple configuration, as in the fifth aspect of the present invention.

In addition, in accordance with the seventh aspect of the present invention, the positive displacement expander is used in the refrigerant circuit (20) of the air conditioner or the like which performs a vapor compression refrigeration cycle, whereby the air conditioner is reduced in vibration as well as in pressure loss. Consequently, damage due to the vibration of the apparatus is avoided and the apparatus is improved in operating efficiency.

In addition, in accordance with the eighth aspect of the present invention, carbon dioxide is used as a refrigerant circulating in the refrigerant circuit (20), thereby making it possible to provide earth-conscious equipment and apparatuses. Especially, for the case of carbon oxide, the same is compressed up to its critical pressure state and pressure variation correspondingly increases, but this pressure variation is effectively inhibited without fail.

BRIEF DESCRIPTION OF THE DRAWINGS

In the accompanying drawings:

FIG. 3, comprised of FIG. 3(A) and FIG. 3(B), is a diagram which shows a principal part of an expansion mechanism according to the first embodiment, wherein

BEST EMBODIMENT MODE FOR CARRYING OUT THE INVENTION

Hereinafter, preferred embodiments of the present invention will be described in detail with reference to the accompanying drawings.

First Embodiment of the Invention

An air conditioner (10) of the present embodiment is equipped with a positive displacement expander of the present invention.

Overall Structure of the Air Conditioner

Figure 1:
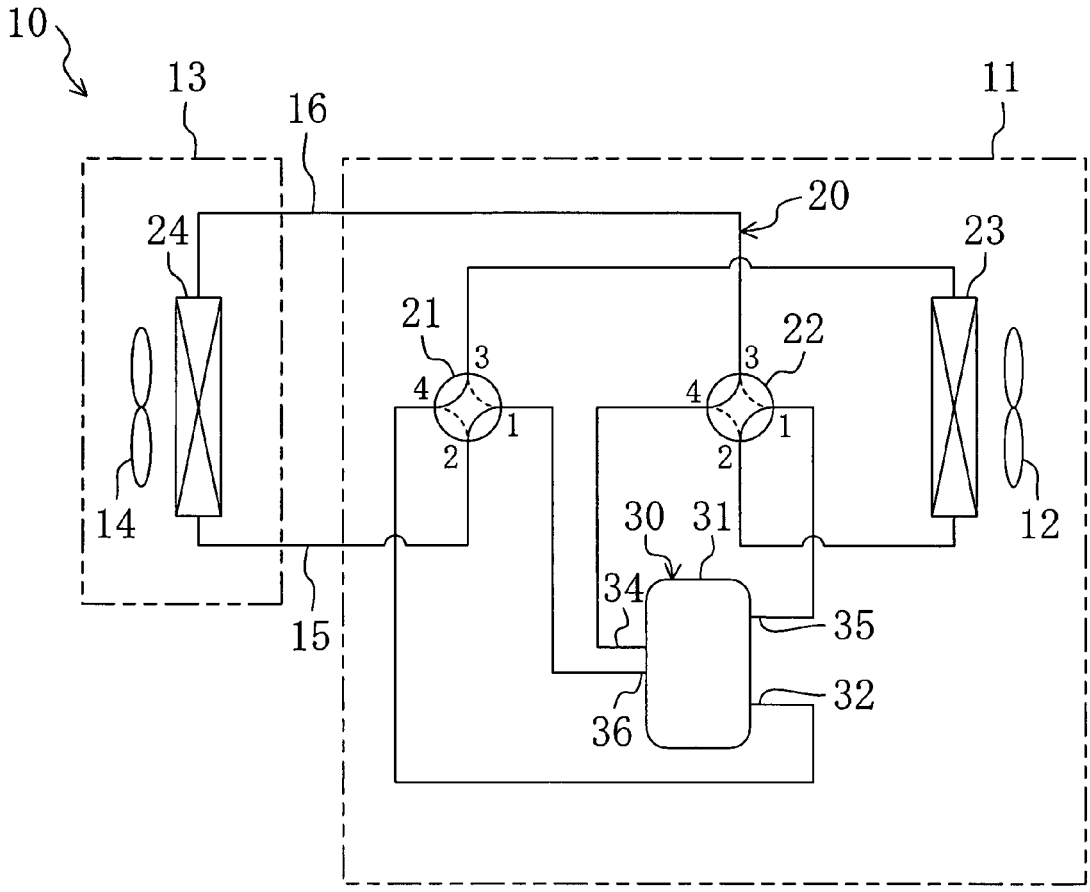
FIG. 1 is a plumbing diagram which shows an air conditioner according to an embodiment of the present invention.

As shown in FIG. 1, the air conditioner (10) is a so-called "separate type" air conditioner, and is equipped with an outdoor unit (11) and an indoor unit (13). The outdoor unit (11) houses therein an outdoor fan (12), an outdoor heat exchanger (23), a first four-way switch valve (21), a second four-way switch valve (22), and a compression/expansion unit (30). On the other hand, the indoor unit (13) houses therein an indoor fan (14) and an indoor heat exchanger (24). The outdoor unit (11) is installed outside a building. The indoor unit (13) is installed inside the building. In addition, the outdoor unit (11) and the indoor unit (13) are connected together by a pair of interunit lines (15, 16). The compression/expansion unit (30) will later be described in detail.

The air conditioner (10) includes a refrigerant circuit (20). The refrigerant circuit (20) is a closed circuit in which the compression/expansion unit (30), the indoor heat exchanger (24) and so on are connected. Additionally, the refrigerant circuit (20) is filled up with carbon dioxide ($CO_2$) as a refrigerant, wherein the refrigerant is circulated in the refrigerant circuit (20) to thereby perform a vapor compression refrigeration cycle.

The outdoor heat exchanger (23) and the indoor heat exchanger (24) are each formed by a respective fin and tube heat exchanger of the cross fin type. In the outdoor heat exchanger (23), refrigerant circulating in the refrigerant circuit (20) exchanges heat with outdoor air taken in by the outdoor fan (12). In the indoor heat exchanger (24), refrigerant circulating in the refrigerant circuit (20) exchanges heat with indoor air taken in by the indoor fan (14).

The first four-way switch valve (21) has four ports of which the first port is connected to a discharge pipe (36) of the compression/expansion unit (30); the second port is connected through the interunit line (15) to one end of the indoor heat exchanger (24) which is a gas side end; the third port is connected to one end of the outdoor heat exchanger (23) which is a gas side end; and the fourth port is connected to a suction port (32) of the compression/expansion unit (30). And, the first four-way switch valve (21) is selectively switchable between a first state (indicated by solid line in FIG. 1) that allows fluid communication between the first port and the second port and fluid communication between the third port and the fourth port and a second state (indicated by broken line in FIG. 1) that allows fluid communication between the first port and the third port and fluid communication between the second port and the fourth port.

The second four-way switch valve (22) has four ports of which the first port is connected to an outflow port (35) of the compression/expansion unit (30); the second port is connected to the other end of the outdoor heat exchanger (23) which is a liquid side end; the third port is connected through the interunit line (16) to the other end of the indoor heat exchanger (24) which is a liquid side end; and the fourth port is connected to an inflow port (34) of the compression/expansion unit (30). And, the second four-way switch valve (22) is selectively switchable between a first state (indicated by solid line in FIG. 1) that allows fluid communication between the first port and the second port and fluid communication between the third port and the fourth port and a second state (indicated by broken line in FIG. 1) that allows fluid communication between the first port and the third port and fluid communication between the second port and the fourth port.

Structure of the Compression/Expansion Unit

Figure 2:
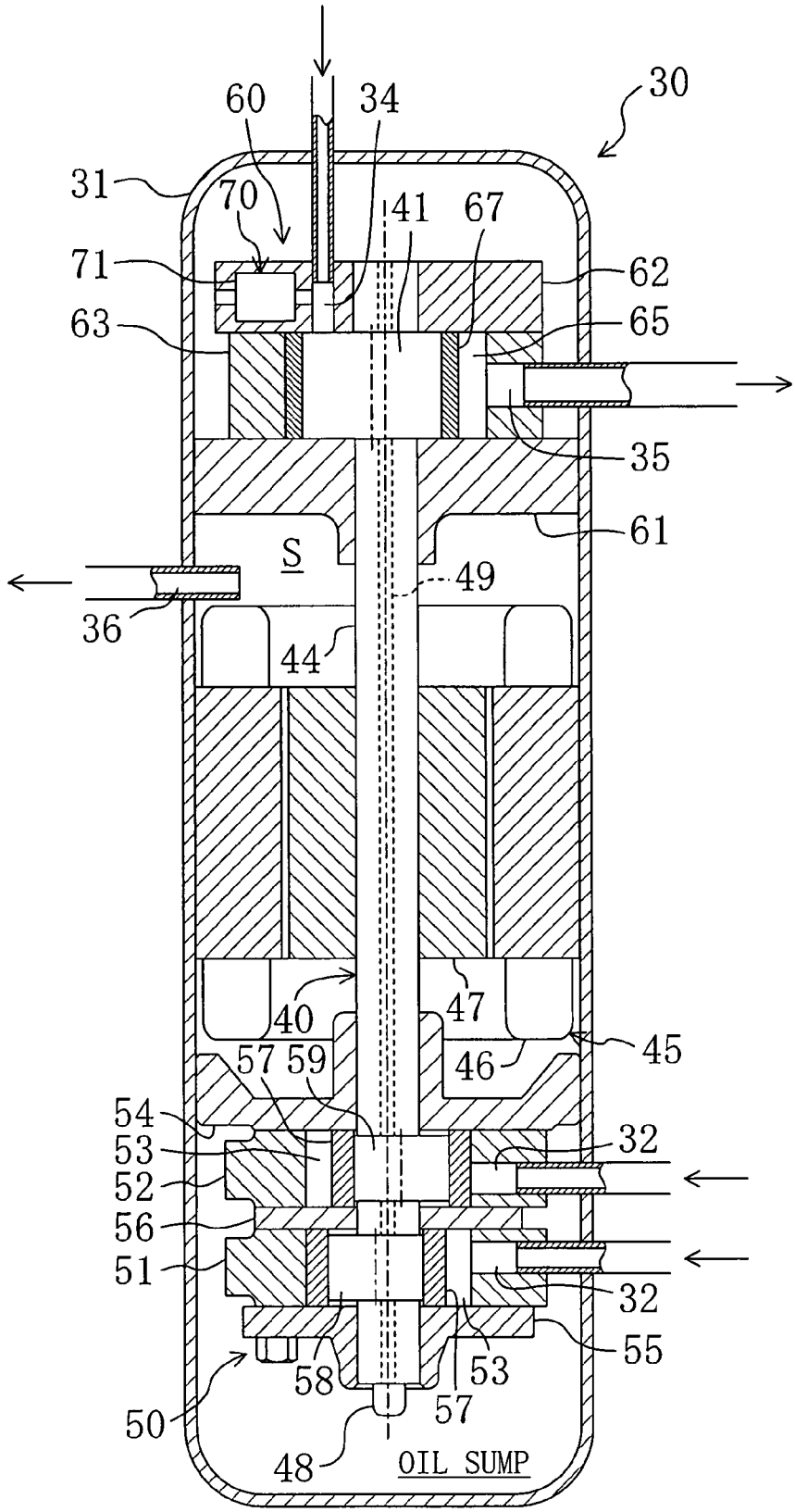
FIG. 2 is a longitudinal cross sectional view which shows a compression/expansion unit according to a first embodiment of the present invention.
Figure 3B:
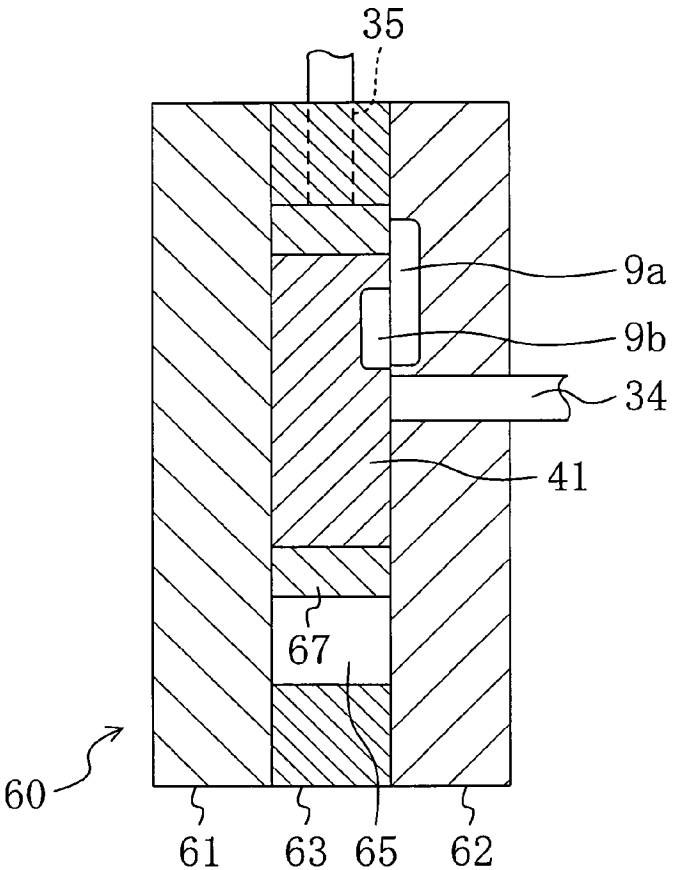
FIG. 3(A) is a transverse cross sectional view and FIG. 3(B) is a longitudinal cross sectional view.
Figure 3A:
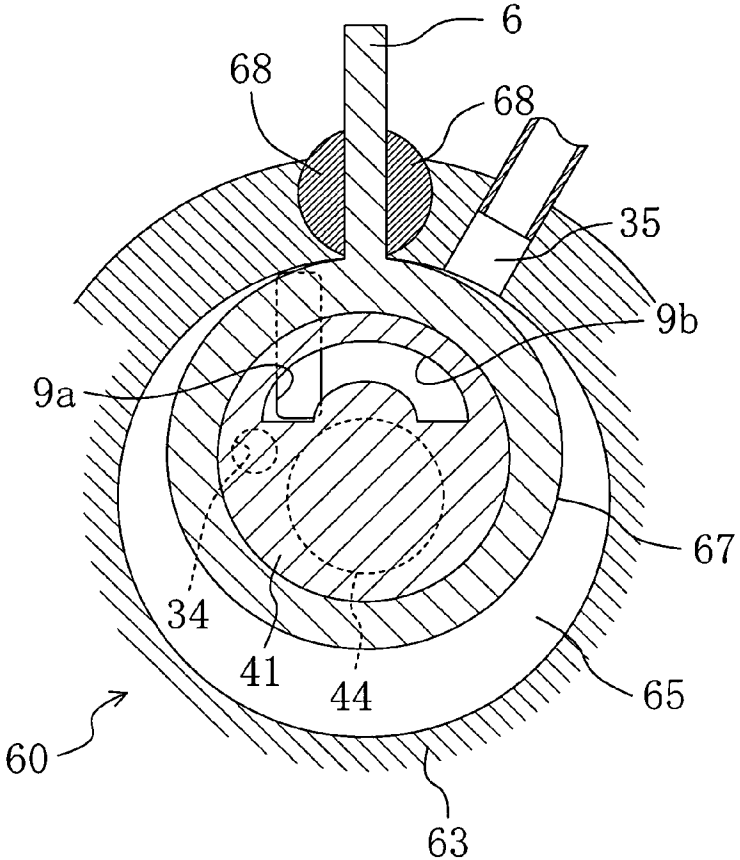
Figure 4:
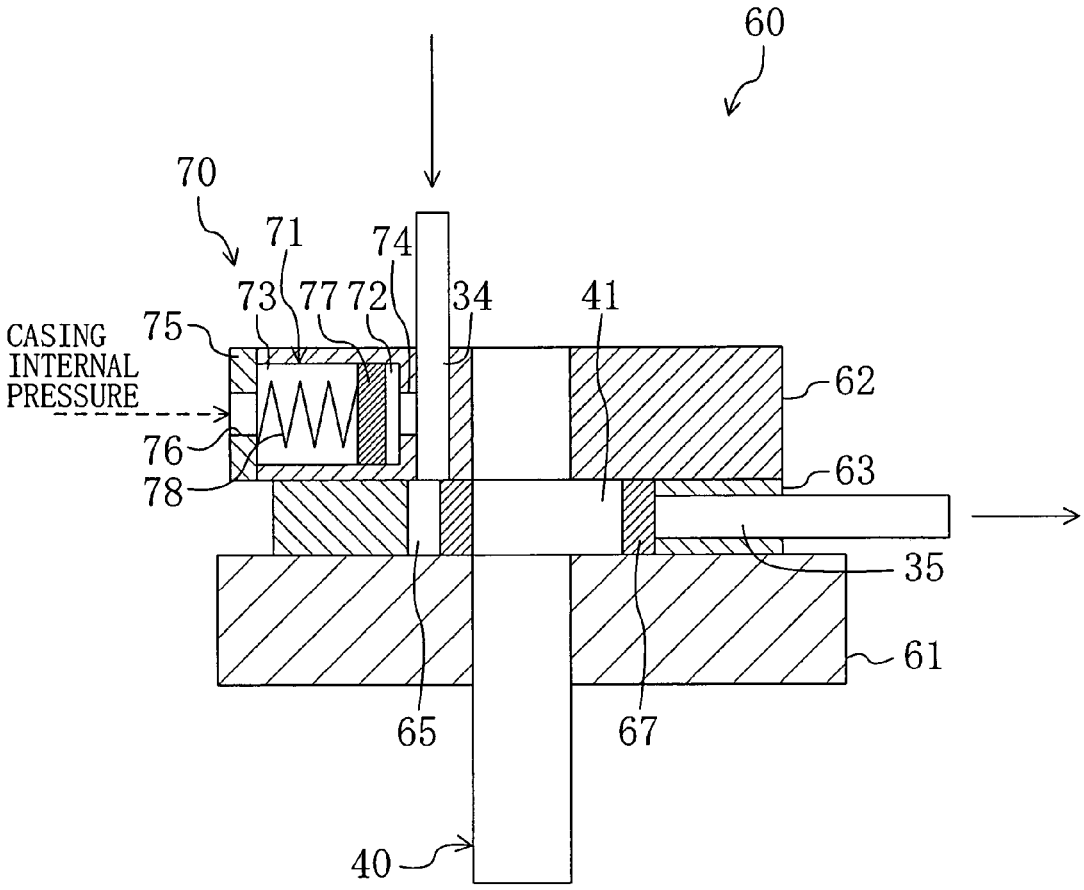
FIG. 4 is a longitudinal cross sectional view which shows a principal part of the expansion mechanism according to the first embodiment.

As shown in FIGS. 2 to 4, the compression/expansion unit (30) constitutes a positive displacement expander of the present invention and includes a casing (31) which is a longitudinally-elongated, cylinder-shaped, hermetically-closed container. Arranged, in a bottom-to-top order, within the casing (31) are a compression mechanism (50), an electric motor (45), and an expansion mechanism (60).

The discharge pipe (36) is connected to the casing (31). The discharge pipe (36) is arranged between the electric motor (45) and the expansion mechanism (60) and fluidly communicates with an internal space (S) within the casing (31).

The electric motor (45) is disposed centrally in the casing (31) relative to the longitudinal direction thereof. The electric motor (45) is made up of a stator (46) and a rotor (47). The stator (46) is firmly secured to the inner surface of the casing (31). The rotor (42) is disposed inside the stator (46) and a main shaft part (44) of a shaft (40) coaxially extends therethrough. The shaft (40) constitutes a rotating shaft. The shaft (40) is provided, at its lower end, with two lower side eccentric parts (58, 59). The shaft (40) is further provided, at its upper end, with a single upper side eccentric part (41).

The two lower side eccentric parts (58, 59) are formed such that they have a greater diameter than that of the main shaft part (44) and are formed eccentrically relative to the center of axle of the main shaft part (44). Of the two lower side eccentric parts (58, 59), the lower one constitutes a first lower side eccentric part (58) and the upper one constitutes a second lower side eccentric part (59). The first lower side eccentric part (58) and the second lower side eccentric part (59) are off-centered oppositely to each other relative to the center of axle of the main shaft part (44). On the other hand, the upper side eccentric part (41) is formed such that it has a greater diameter than that of the main shaft part (44, and is formed eccentrically relative to the center of axle of the main shaft part (44).

The compression mechanism (50) constitutes a rotary compressor of the swinging piston type. The compression mechanism (50) has two cylinders (51, 52) and two rotary pistons (57, 57). In the compression mechanism (50), a rear head (55), a first cylinder (51), an intermediate plate (56), a second cylinder (52), and a front head (54) are arranged in layered fashion in a bottom-to-top order.

The first and second cylinders (51, 52) contain therein respective cylinder-shaped rotary pistons (57, 57). Although not shown diagrammatically in the figure, the rotary piston (57, 57) has, at its side surface, a projected, flat plate-like blade. The blade is supported, through swinging bushes, by the cylinder (51, 52). The rotary piston (57) within the first cylinder (51) engages with the first lower side eccentric part (58) of the shaft (40). On the other hand, the rotary piston (57) within the second cylinder (52) engages with the second lower side eccentric part (59) of the shaft (40). The rotary piston (57) within the first cylinder (51) is, at its inner peripheral surface, in sliding contact with the outer peripheral surface of the first lower side eccentric part (58) and is, at its outer peripheral surface, in sliding contact with the inner peripheral surface of the first cylinder (51). On the other hand, the rotary piston (57) within the second cylinder (52) is, at its inner peripheral surface, in sliding contact with the outer peripheral surface of the second lower side eccentric part (59) and is, at its outer peripheral surface, in sliding contact with the inner peripheral surface of the second cylinder (52). And, a compression chamber (53, 53) is defined between the outer peripheral surface of the rotary piston (57, 57) and the inner peripheral surface of the cylinder (51, 52).

Each of the first and second cylinders (51, 52) is provided with a respective suction port (32). The suction port (32, 32) radially extends through the cylinder (51,52), with the terminating end opening into the cylinder (51, 52). In addition, each suction port (32, 32) is extended to outside the casing (31) by piping.

Each of the front and rear heads (54, 55) is provided with a respective discharge port (not shown). The discharge port of the front head (54) allows the compression chamber (53) within the second cylinder (52) and the internal space (S) of the casing (31) to fluidly communicate with each other. On the other hand, the discharge port of the rear head (55) allows the compression chamber (53) within the first cylinder (51) and the internal space (S) of the casing (31) to fluidly communicate with each other. In addition, each discharge port is provided, at its terminating end, with a respective discharge valve (not shown) which is formed by a reed valve, and is placed in the open or closed state by the discharge valve. And, high pressure gas refrigerant discharged into the internal space (S) of the casing (31) from the compression mechanism (50) is discharged out of the compression/expansion unit (30) by way of the discharge pipe (36).

An oil sump in which lubricating oil is collected is formed at the bottom of the casing (31). Mounted at the lower end of the shaft (40) is a centrifugal oil pump (48) which is dipped in the oil sump. The oil pump (48) is configured such that it pumps up lubricating oil in the oil sump by rotation of the shaft (40). An oil supply groove (49) is formed in the shaft (40) such that it extends across the shaft (40). The oil supply groove (49) is formed such that lubrication oil pumped up by the oil pump (48) is supplied to sliding parts of the compression and expansion mechanisms (50, 60).

The expansion mechanism (60) constitutes a rotary expander of the swinging piston type. The expansion mechanism (60) includes a front head (61), a rear head (62), a cylinder (63), and a rotary piston (67).

In the expansion mechanism (60), the front head (61), the cylinder (63), and the rear head (62) are arranged in layered fashion in a bottom-to-top order. The lower and upper end surfaces of the cylinder (63) are blocked respectively by the front and rear heads (61, 62). The shaft (40) is passed through each of the layered components, in other words, the shaft (40) is passed through the front head (61), then through the cylinder (63), and then through the rear head (62) and the upper side eccentric part (41) is located within the cylinder (63).

The rotary piston (67) is housed within the cylinder (63) whose upper and lower ends are blocked. The rotary piston (67) is shaped like a circular ring or cylinder and the upper side eccentric part (41) of the shaft (40) is rotatably engaged into the rotary piston (67). In addition, the rotary piston (67) is, at its outer peripheral surface, in sliding contact with the inner peripheral surface of the cylinder (63). Furthermore, the rotary piston (67) is, at its upper end surface, in sliding contact with the rear head (62) and is, at its lower end surface, in sliding contact with the front head (61). And, an expansion chamber (65) is formed between the inner peripheral surface of the cylinder (63) and the outer peripheral surface of the rotary piston (67). In other words, the front head (61), the rear head (62), the cylinder (63), and the rotary piston (67) together constitute a forming member of the expansion chamber (65).

A blade (6) is formed integrally with the rotary piston (67). The blade (6) is shaped like a plate extending in the radial direction of the rotary piston (67). The blade (6) projects outwardly from the outer peripheral surface of the rotary piston (67). The expansion chamber (65) within the cylinder (63) is divided by the blade (6) into a high pressure side (suction/expansion side) and a low pressure side (discharge side). The cylinder (63) is provided with a pair of bushes (68, 68). The pair of bushes (68, 68) are each formed into an approximately crescentic shape having an inside surface which is a flat surface and an outside surface which is a circular arc surface and are mounted, with the blade (6) held therebetween. The inside surface of the bush (68, 68) slides against the blade (6) while on the other hand the outside surface of the bush (68, 68) slides against the cylinder (63). The blade (6) is supported through the bush (68, 68) by the cylinder (63) and is configured rotatably retractably relative to the cylinder (63).

The expansion mechanism (60) is provided with an inflow port (34) formed in the rear head (62) and an outflow port (35) formed in the cylinder (63). The inflow port (34) vertically extends in the rear head (62) and its terminating end is opened at the position in the inside surface of the rear head (62) that is not in direct fluid communication with the expansion chamber (65). More specifically, the terminal end of the inflow port (34) is opened at a somewhat upper left-hand position relative to the center of axle of the main shaft part (44) in FIG. 3(A), in an area of the inside surface of the rear head (62) that slide-contacts with the end surface of the upper side eccentric part (41). On the other hand, the outflow port (35) radially extends in the cylinder (63) and its terminal end is opened on the low pressure side in the cylinder (63). In addition, the inflow and outflow ports (34, 35) are extended by piping to outside the casing (31). And, in the expansion mechanism (60), high pressure refrigerant is drawn through the inflow port (34) into the high pressure side in the cylinder (63) and expanded. Low pressure refrigerant after expansion is delivered through the outflow port (35) to outside the casing (31) from the low pressure side. In other words, the inflow and outflow ports (34, 35) constitute, respectively, a refrigerant suction passageway and a refrigerant discharge passageway in the expansion mechanism (60).

The rear head (62) is provided with a groove-shaped passageway (9*a*). As shown in FIG. 3(B), the groove-shaped passageway (9*a*) is formed by grooving a portion of the inside surface of the rear head (62) into a concave groove shape having an opening at the inside surface of the rear head (62). The opening portion of the groove-shaped passageway (9*a*) is formed into a vertically elongated rectangular shape in FIG. 3(A), and is located on the left-hand side of the center of axle of the main shaft part (44) in FIG. 3(A). In addition, the upper end of the groove-shaped passageway (9*a*) in FIG. 3(A) is located slightly interior to the inner peripheral surface of the cylinder (63) while the lower end of the groove-shaped passageway (9*a*) in FIG. 3(A) is located in a portion of the inside surface of the rear head (62) that comes into slide contact with the end surface of the upper side eccentric part (41). And, the groove-shaped passageway (9*a*) is fluidly communicable with the expansion chamber (65).

The upper side eccentric part (41) of the shaft (40) is provided with a connecting passageway (9*b*). As shown in FIG. 3(B), the connecting passageway (9*b*) is formed by grooving a portion of the end surface of the upper side eccentric part (41) into a concave groove shape having an opening at the end surface of the upper side eccentric part (41) facing the rear head (62). In addition, as shown in FIG. 3(A), the connecting passageway (9*b*) is shaped like a circular arch extending along the outer circumference of the upper side eccentric part (41). Furthermore, the circumferential center in the connecting passageway (9*b*) lies on a line connecting the center of axle of the main shaft part (44) and the center of axle of the upper side eccentric part (41) and is positioned opposite to the center of axle of the main shat part (44) relative to the center of axle of the upper side eccentric part (41). And, as the shaft (40) rotates, the connecting passageway (9*b*) of the upper side eccentric part (41) moves as well, whereby the inflow port (34) and the groove-shaped passageway (9*a*) are brought into intermittent fluid communication with each other through the connecting passageway (9*b*). Note that FIG. 3 omits representation of a pressure snubbing means (70) which will be described later.

In addition, the expansion mechanism (60) is provided with the pressure snubbing means (70) which is a feature of the present invention. The pressure snubbing means (70) includes a pressure snubbing chamber (71) formed in the inside of the rear head (62).

More specifically, the pressure snubbing chamber (71) responds to the inflow port (34) (see FIG. 4) and is located nearer to the outer peripheral side of the rear head (62) than the inflow port (34). The pressure snubbing chamber (71) is shaped like a rectangle when viewed in cross section and extends in the radial direction of the rear head (62). Note that, although not diagrammatically represented in the figure, the pressure snubbing chamber (71) is disposed such that it will not interfere with the groove-shaped passageway (9*a*).

The pressure snubbing chamber (71) is provided, in its inside, with a piston (77) and a spring (78). The piston (77) is shaped like a plate and has a rectangular shape (when viewed from top) corresponding to the cross sectional shape of the pressure snubbing chamber (71). And, the piston (77) divides, sequentially outwardly relative to the radial direction of the rear head (62), the pressure snubbing chamber (71) into an inflow/outflow chamber (72) and a back pressure chamber (73). In other words, the piston (77) constitutes a partitioning member for the pressure snubbing chamber (71). On the other hand, the spring (78) is mounted between the piston (77) and a blocking lid (75) in the back pressure chamber (73).

Formed within the rear head (62) is a communicating passageway (74) for allowing the inflow/outflow chamber (72) of the pressure snubbing chamber (71) to fluidly communicate with an intermediate part of the inflow port (34). In other words, the inflow/outflow chamber (72) is configured such that it is filled up with refrigerant flowing in the inflow port (34) and is placed in the same pressure state as the refrigerant. In addition, the pressure snubbing chamber (71) is provided with the blocking lid (75) for closing the back pressure chamber (73) from the outer peripheral side of the rear head (62). And, the blocking lid (75) is provided with a communicating hole (76) for allowing the back pressure chamber (73) to fluidly communicate with the internal space (S) of the casing (31). Stated another way, the back pressure chamber (73) is configured such that it is filled up with high pressure gas discharged out of the compression mechanism (50) and is held in the same pressure state as the discharge pressure of the compression mechanism (50) which is the pressure in the casing (31).

In the pressure snubbing chamber (71), the degree of extension of the spring (78) is set such that it becomes zero when the pressure of the inflow/outflow chamber (72) and the pressure of the back pressure chamber (73) becomes balanced with each other in the normal condition. And, the pressure snubbing chamber (71) is configured such that the piston (77) slidingly moves in the radial direction of the rear head (62) in response to variation in the pressure within the inflow/outflow chamber (72). In other words, the piston (77) is displaceably configured such that the volume of the inflow/outflow chamber (72) varies in response to variation in the pressure of refrigerant in the inflow port (34).

Therefore, when the refrigerant pressure decreases, the piston (77) shifts towards the inflow/outflow chamber (72) to thereby discharge refrigerant in the inflow/outflow chamber (72) to the inflow port (34). By means of this, the drop in the refrigerant pressure is reduced. On the other hand, when the refrigerant pressure increases, the piston (77) shifts towards the back pressure chamber (73) to thereby draw refrigerant in the inflow port (34) into the inflow/outflow chamber (72). By means of this, the rise in the refrigerant pressure is reduced. To sum up, the pressure snubbing chamber (71) is configured such that it performs discharge of refrigerant into or suction of refrigerant from the inflow port (34) in response to variation in the pressure of suction refrigerant to thereby reduce pressure variation.

As described above, the pressure snubbing chamber (71) is arranged in extremely close proximity to the inflow port (34) which is a source of pressure variation, and performs discharge of refrigerant into or suction of refrigerant from the inflow port (34). Therefore, inhibitive force against pressure variation is further enhanced and, in addition, its response property is further improved than is possible in the prior art in which the accumulator lies away from a source of pressure variation. By means of this, pressure variation is inhibited to a further extent.

Running Operation

Next, description will be made in regard to the running operation of the air conditioner (10). Here, the operation of the air conditioner (10) during a cooling mode and the operation of the air conditioner (10) during a heating mode are first described. Thereafter, the operation of the expansion mechanism (60) is described.

Cooling Operation Mode

In the cooling operation mode, the first and second four-way switch valves (21, 22) change their state to the state indicated by broken line in FIG. 1. In this state, the electric motor (45) of the compression/expansion unit (30) is energized, and a vapor compression refrigeration cycle is performed as refrigerant is circulated in the refrigerant circuit (20).

High pressure refrigerant compressed in the compression mechanism (50) is discharged out of the compression/expansion unit (30) by way of the discharge pipe (36). In this state, the high pressure refrigerant has a higher pressure than its critical pressure. The high pressure refrigerant flows through the first four-way switch valve (21) into the outdoor heat exchanger (23). In the outdoor heat exchanger (23), the inflow high pressure refrigerant dissipates heat to outdoor air.

The high pressure refrigerant after heat dissipation in the outdoor heat exchanger (23) passes through the second four-way switch valve (22) and flows into the expansion chamber (65) of the expansion mechanism (60) from the inflow port (34). In the expansion chamber (65), the high pressure refrigerant expands and its internal energy is converted into power for rotating the shaft (40). The low pressure refrigerant after expansion flows out of the compression/expansion unit (30) by way of the outflow port (35) and is delivered through the second four-way switch valve (22) to the indoor heat exchanger (24).

In the indoor heat exchanger (24), the inflow low pressure refrigerant absorbs heat from indoor air and is evaporated whereby the indoor air is cooled. And, low pressure gas refrigerant exiting the indoor heat exchanger (24) passes through the first four-way switch valve (21) and is drawn into the compression mechanism (50) of the compression/expansion unit (30) from the suction port (32). And, the compression mechanism (50) compresses the drawn refrigerant and discharges it therefrom.

Heating Operation Mode

During the heating operation mode, the first and second four-way switch valves (21, 22) change their state to the state indicated by solid line in FIG. 1. In this state, the electric motor (45) of the compression/expansion unit (30) is energized, and a vapor compression refrigeration cycle is performed as refrigerant is circulated in the refrigerant circuit (20).

High pressure refrigerant compressed in the compression mechanism (50) is discharged out of the compression/expansion unit (30) by way of the discharge pipe (36). In this state, the high pressure refrigerant has a higher pressure than its critical pressure. The high pressure refrigerant flows through the first four-way switch valve (21) into the indoor heat exchanger (24). In the indoor heat exchanger (24), the inflow high pressure refrigerant dissipates heat to indoor air whereby the indoor air is heated.

The high pressure refrigerant after heat dissipation in the indoor heat exchanger (24) passes through the second four-way switch valve (22) and flows into the expansion chamber (65) of the expansion mechanism (60) from the inflow port (34). In the expansion chamber (65), the high pressure refrigerant is expanded and its internal energy is converted into power for rotating the shaft (40). And, the expanded refrigerant now at low pressure flows out of the compression/expansion unit (30) by way of the outflow port (35) and is delivered through the second four-way switch valve (22) to the outdoor heat exchanger (23).

In the outdoor heat exchanger (23), the inflow low pressure refrigerant absorbs heat from outdoor air and is evaporated.

And, low pressure gas refrigerant exiting the outdoor heat exchanger (23) passes through the first four-way switch valve (21) and is drawn into the compression mechanism (50) of the compression/expansion unit (30) from the suction port (32). And, the compression mechanism (50) compresses again the drawn refrigerant and discharges it therefrom.

Operation of the Compression Mechanism

Figure 5:
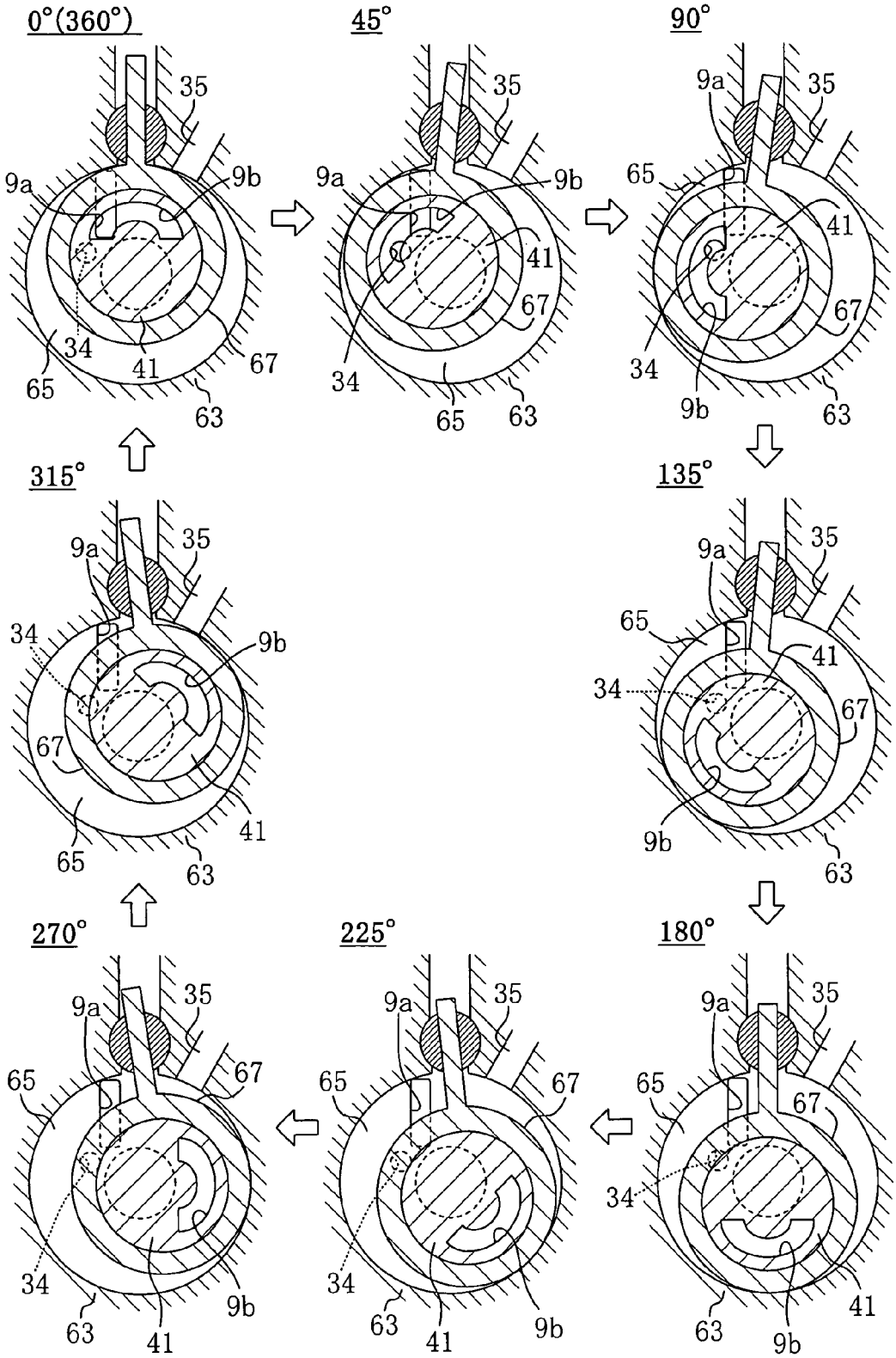
FIG. 5 is a transverse cross sectional view which illustrates operating states of the expansion mechanism according to the first embodiment.

Referring to FIG. 5, description will be made in regard to the operation of the expansion mechanism (60). As supercritical high pressure refrigerant flows into the expansion chamber (65) of the expansion mechanism (60), the shaft (40) is rotated counterclockwise relative to the figure. Note that FIG. 5 illustrates operation states of the expansion mechanism (60) for every 45° rotation of the shaft (40).

When the shaft (40) is at a rotational angle of 0 degrees, the terminal end of the inflow port (34) is closed by the end surface of the upper side eccentric part (41). On the other hand, a part of the connecting passageway (9*b*) of the upper side eccentric part (41) is in fluid communication only with the groove-shaped passageway (9*a*) while the rest of the groove-shaped passageway (9*a*) is closed by the end surface of the rotary piston (67) and the end surface of the upper side eccentric part (41), and is not in fluid communication with the expansion chamber (65). In addition, the expansion chamber (65) is in fluid communication with the outflow port (35), whereby the entire expansion chamber (65) becomes a low pressure side. Therefore, at this point of time, the expansion chamber (65) is blocked off from the inflow port (34) and no high pressure refrigerant will flow into the expansion chamber (65).

When the shaft (40) is at a rotational angle of 45 degrees, the inflow port (34) is in fluid communication with the connecting passageway (9*b*). In addition, the connecting passageway (9*b*) is in fluid communication with the groove-shaped passageway (9*a*). The upper end of the groove-shaped passageway (9*a*) in FIG. 5 deviates from the end surface of the rotary piston (67), and comes into fluid communication with the high pressure side of the expansion chamber (65). At this point of time, the expansion chamber (65) is in fluid communication with the inflow port (34) through the groove-shaped passageway (9*a*) and through the connecting passageway (9*b*), and high pressure refrigerant flows into the high pressure side of the expansion chamber (65). That is to say, the inflowing of high pressure refrigerant into the expansion chamber (65) is started during the time between when the shaft (40) is at a rotational angle of 0 degrees and when the shaft (40) reaches a rotational angle of 45 degrees.

When the shaft (40) is at a rotational angle of 90 degrees, the expansion chamber (65) still remains in fluid communication with the inflow port (34) through the groove-shaped passageway (9*a*) and through the connecting passageway (9*b*). Therefore, the inflowing of high pressure refrigerant into the high pressure side of the expansion chamber (65) continues during the time between when the shat (40) is at a rotational angle of 45 degrees and when the shaft (40) reaches a rotational angle of 90 degrees.

When the shaft (40) is at a rotational angle of 135 degrees, the connecting passageway (9*b*) deviates from the groove-shaped passageway (9*a*) as well as from the inflow port (34). At this point in time, the expansion chamber (65) is blocked off from the inflow port (34) and no high pressure refrigerant will flow into the expansion chamber (65). In other words, the inflowing of high pressure refrigerant into the expansion chamber (65) is terminated during the time between from when the shaft (40) is at a rotational angle of 90 degrees to when the shaft (40) is at a rotational angle of 135 degrees.

Upon completion of the inflowing of high pressure refrigerant into the expansion chamber (65), the high pressure side of the expansion chamber (65) becomes a closed space and the refrigerant therein is expanded. In other words, the shaft (40) rotates and the volume of the high pressure side volume of the expansion chamber (65) increases, as shown in FIG. 5. During that time, low pressure refrigerant after expansion is continuously discharged through the outflow port (35) from the low pressure side of the expansion chamber (65) in fluid communication with the outflow port (35).

The expansion of refrigerant in the expansion chamber (65) continues until the contact part with the cylinder (63) in the rotary piston (67) reaches the outflow port (35) during the time between from when the shaft (40) is at a rotational angle of 315 degrees to when the shaft (40) reaches a rotational angle of 360 degrees. And, when the contact part with the cylinder (63) in the rotary piston (67) starts passing through the outflow port (35), the expansion chamber (65) comes into fluid communication with the outflow port (35) and the discharging of expanded refrigerant is commenced. Thereafter, when the contact part with the cylinder (63) in the rotary piston (67) has passed through the outflow port (35), the expansion chamber (65) is blocked off from the outflow port (35) and the discharging of expanded refrigerant is terminated.

As described above, suction of refrigerant and discharge of refrigerant in the expansion mechanism (60) of the positive displacement type is determined by the rotational angle of the shaft (40). Therefore, the suction amount of refrigerant and the discharge amount of refrigerant in the expansion mechanism (60) become intermittent through a cycle. Accordingly, in the expansion mechanism (60), variation in the pressure of suction refrigerant (pressure pulsation) and variation in the pressure of discharge refrigerant (pressure pulsation) will occur in the inflow port (34) and in the outflow port (35).

In regard to the above, the operation of the pressure snubbing means (70) is described. Due to variation in the pressure of suction refrigerant, the pressure of refrigerant in the inflow/outflow chamber (72) of the pressure snubbing chamber (71) varies as well. This creates a difference in pressure between the inflow/outflow chamber (72) and the back pressure chamber (73).

Here, for example, if the pressure of suction refrigerant in the inflow port (34) decreases, the pressure of refrigerant in the inflow/outflow chamber (72) falls below the pressure of refrigerant in the back pressure chamber (73), and the piston (77) slidingly shifts towards the inflow/outflow chamber (72). In addition, at the same time, the spring (78) extends. As the piston (77) moves, the volume of the inflow/outflow chamber (72) decreases, and the same amount of refrigerant as the decreased volume is discharged through the communicating passageway (74) to the inflow port (34) from the inflow/outflow chamber (72). By means of this, it becomes possible to reduce the drop in the pressure of suction refrigerant in the inflow port (34). In other words, the pressure snubbing chamber (71) provides a supply of pressure to the suction refrigerant. And, the suction refrigerant in the inflow port (34), the inflow/outflow chamber (72), and the back pressure chamber (73) are pressure-balanced with each other, and the piston (77) is returned back to its normal predetermined position. At that time, the piston (77) is pulled towards the back pressure chamber (73) by elastic force generated when the spring (78) extends, thereby making sure that the piston (77) moves to the predetermined position.

On the other hand, if the pressure of suction refrigerant in the inflow port (34) increases, the pressure of refrigerant in the inflow/outflow chamber (72) exceeds the pressure of refrigerant in the back pressure chamber (73), and the piston (77) slidingly shifts towards the back pressure chamber (73). In addition, at the same time, the spring (78) retracts. As the piston (77) moves, the volume of the inflow/outflow chamber (72) increases, and the same amount of refrigerant as the increased volume is drawn through the communicating passageway (74) into the inflow/outflow chamber (72) from the inflow port (34). By means of this, it becomes possible to reduce the rise in the pressure of suction refrigerant in the inflow port (34). In other words, the pressure snubbing chamber (71) absorbs pressure from the suction refrigerant. And, the suction refrigerant in the inflow port (34), the inflow/outflow chamber (72), and the back pressure chamber (73) are pressure-balanced with each other, and the piston (77) is returned back to its normal predetermined position. At that time, the piston (77) is pushed towards the inflow/outflow chamber (72) by elastic force generated when the spring (78) retracts, thereby making sure that the piston (77) moves to the predetermined position.

As described above, the action of inhibition against variation in the pressure of suction refrigerant is performed by the pressure snubbing chamber (71) disposed at little distance from the inflow port (34) which is a source of suction refrigerant pressure variation. As a result of such arrangement, inhibitive force against pressure variation is enhanced and the property of response is improved in comparison with the conventional case where the accumulator is installed outside the casing at a distance from the expansion mechanism. Therefore, variation in the pressure of suction refrigerant is effectively inhibited. As a result of this, suction pressure loss is reduced and, in addition, the vibration of the entire equipment is inhibited.

Advantageous Effects of the First Embodiment

As described above, in accordance with the first embodiment of the present invention, the pressure snubbing means (70), configured to inhibit variation in the pressure of suction refrigerant which is drawn into the expansion chamber (65), is arranged within the casing (31), whereby the pressure snubbing means (70) is allowed to exercise its inhibitive force at the position extremely close to the inflow port (34) of the expansion mechanism (60) which is a source of suction refrigerant pressure variation. Accordingly, the action of inhibition against pressure variation is exhibited more effectively than is possible in the prior art and the property of response of the inhibitive action is expedited. Therefore, variation in the pressure of suction refrigerant is reduced effectively. Hereby, the equipment is effectively reduced in vibration due to pressure variation and, in addition, it becomes possible to improve the equipment in reliability and operating efficiency.

Especially, the pressure snubbing chamber (71) performs discharge of refrigerant into and suction of refrigerant from the inflow port (34) which is a source of pressure variation to thereby inhibit pressure variation. As a result of this arrangement, the action of inhibition is worked further effectively and the property of response is improved to a further extent. Furthermore, the pressure snubbing chamber (71) is defined within the rear head (62) of the expansion mechanism (60). As a result of this arrangement, not only inhibitive force can positively be exerted at the position near to the inflow port (34), but it is also possible to prevent the equipment from growing in size because there is no need to secure a separate installation space in which to form the pressure snubbing chamber (71).

In addition, the pressure snubbing chamber (71) is divided by the piston (77) into the inflow/outflow chamber (72) in fluid communication with the inflow port (34) and the back pressure chamber (73). The piston (77) slidingly moves in response to variation in the suction pressure to thereby cause the volume of the inflow/outflow chamber (72) to vary. As a result of such arrangement, it becomes possible to positively perform discharge of refrigerant into the inflow port (34) from the inflow/outflow chamber (72) and suction of refrigerant from the inflow port (34) into the inflow/outflow chamber (72). By means of this, variation in the suction pressure is effectively inhibited without fail.

Especially, the back pressure chamber (73) is brought into fluid communication with the internal space (S) of the casing (31), whereby the discharge pressure of the compression mechanism (50) arranged within the casing (31) is used as a back pressure. Accordingly, there is no need to separately provide a back pressure means and suction refrigerant pressure variation is effectively inhibited by an inexpensive and simple configuration as compared to the case when using an accumulator which is rather expensive and heavily equipped.

In addition, it is arranged such that the spring (78) is mounted to the piston (77). As a result of such arrangement, it becomes possible to enhance the slide shifting of the piston (77) by elastic force generated by extension and contraction of the spring (78). Therefore, it is possible to enable the piston (77) to move while following variation in the suction pressure without fail. As a result of this, the property of response of the inhibitive action is improved to a further extent.

In addition, carbon dioxide is used as a refrigerant circulating in the refrigerant circuit (20), thereby making it possible to provide earth-conscious equipment and apparatuses. Especially, for the case of carbon oxide, the same is compressed to its critical pressure state and variation in the suction pressure correspondingly increases, but this pressure variation is effectively inhibited without fail.

Variations of the First Embodiment

Figure 6:
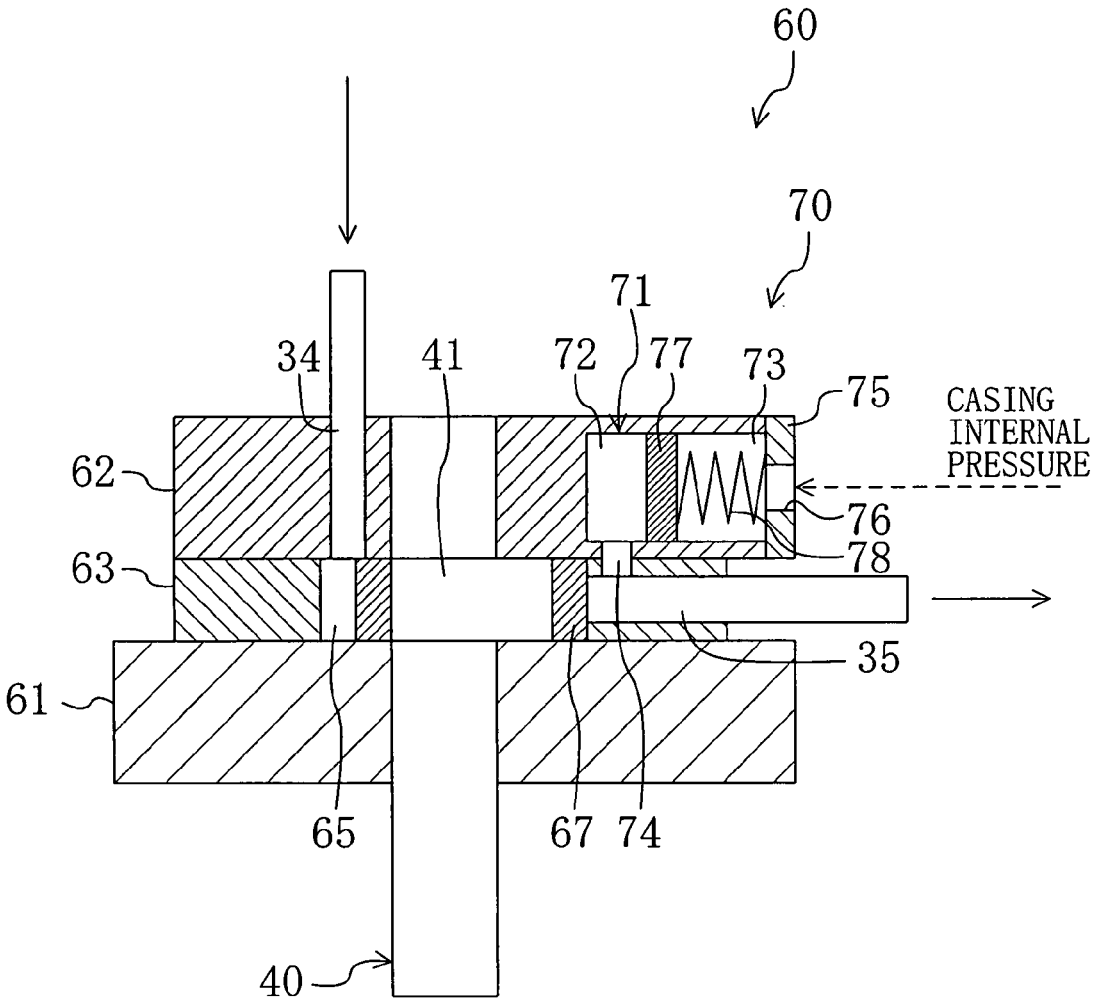
FIG. 6 is a longitudinal cross sectional view which shows a principal part of an expansion mechanism according to a first variation of the first embodiment.

Referring now to the drawings, variations of the first embodiment of the present invention are described. Referring first to FIG. 6, there is shown a first variation of the first embodiment. Unlike the above-described first embodiment in which variation in the pressure of suction refrigerant is inhibited, variation in the pressure of discharge refrigerant is inhibited in the first variation. More specifically, the pressure snubbing chamber (71) of the pressure snubbing means (70) is formed in the position within the rear head (62) corresponding to the outflow port (35). And, the pressure snubbing chamber (71) is provided with a communicating passageway (74) for allowing the inflow/outflow chamber (72) to fluidly communicate with the outflow port (35). In other words, the communicating passageway (74) is formed such that it extends over the rear head (62) and the cylinder (63). Hereby, variation in the pressure of discharge refrigerant can be inhibited effectively. Other configurations, operations, and working effects of the first variation are the same as the first embodiment.

Figure 7:
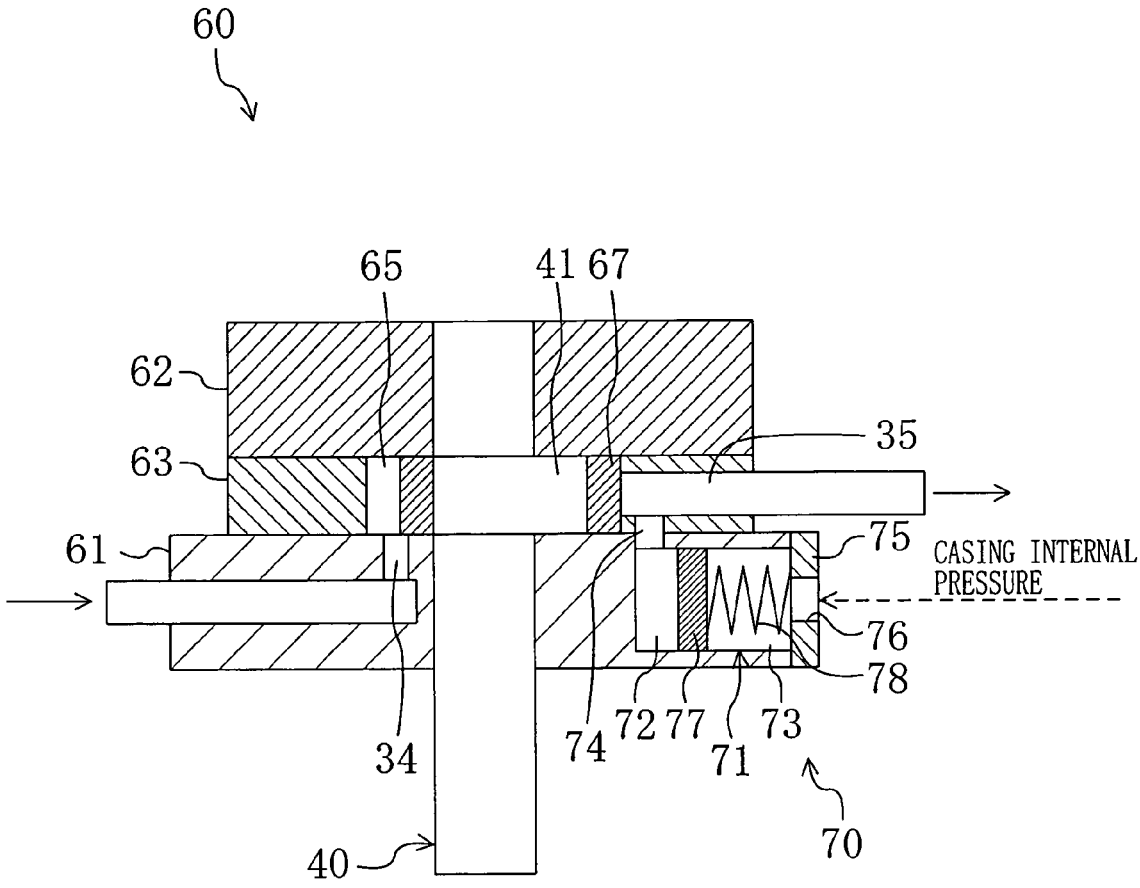
FIG. 7 is a longitudinal cross sectional view which shows a principal part of an expansion mechanism according to a second variation of the first embodiment.

Referring next to FIG. 7, there is shown a second variation of the first embodiment. Unlike the above-described first variation in which the pressure snubbing chamber (71) is formed in the rear head (62), the pressure snubbing chamber (71) of the second variation is formed in the front head (61). More specifically, the pressure snubbing chamber (71) is formed in the position within the front head (61) corresponding to the outflow port (35) and the communicating passageway (74) is formed such that it extends over the front head (61) and the cylinder (63). In addition, the inflow port (34) is formed not in the rear head (62) but in the front head (61). In other words, the starting end of the inflow port (34) opens at the outer peripheral surface of the front head (61) while the terminating end thereof extends radially inwardly and then extends upwardly to open to the expansion chamber (65). In this way as described above, it is arranged such that the pressure snubbing chamber (71) and the inflow port (34) are concentrated in the front head (61), whereby the work efficiency of member processing is improved. Other configurations, operations, and working effects of the second variation are the same as the first embodiment.

Figure 8:
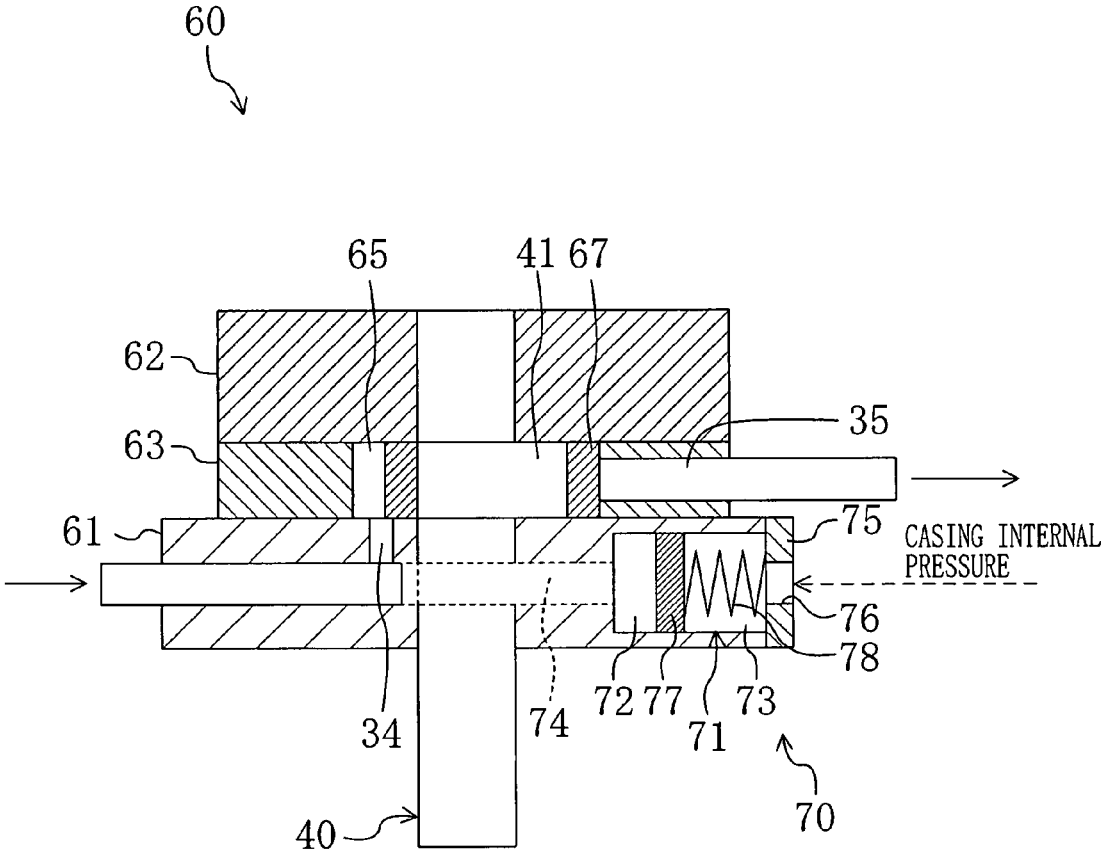
FIG. 8 is a longitudinal cross sectional view which shows a principal part of an expansion mechanism according to a third variation of the first embodiment.

Referring next to FIG. 8, there is shown a third variation of the first embodiment. Unlike the first embodiment in which both the inflow port (34) and the pressure snubbing chamber (71) are formed in the rear head (62), both are formed in the front head (61) in the third variation. More specifically, the inflow port (34) is formed in the same way as the second variation. The pressure snubbing chamber (71) is formed opposite to the inflow port (34) relative to the shaft (40). And, the inflow port (34) and the inflow/outflow chamber (72) of the pressure snubbing chamber (71) are connected together by the communicating passageway (74). In other words, the communicating passageway (74) is formed such that it circumferentially extends approximately half around. Other configurations, operations, and working effects of the third variation are the same as the first embodiment.

Second Embodiment of the Invention

Figure 9:
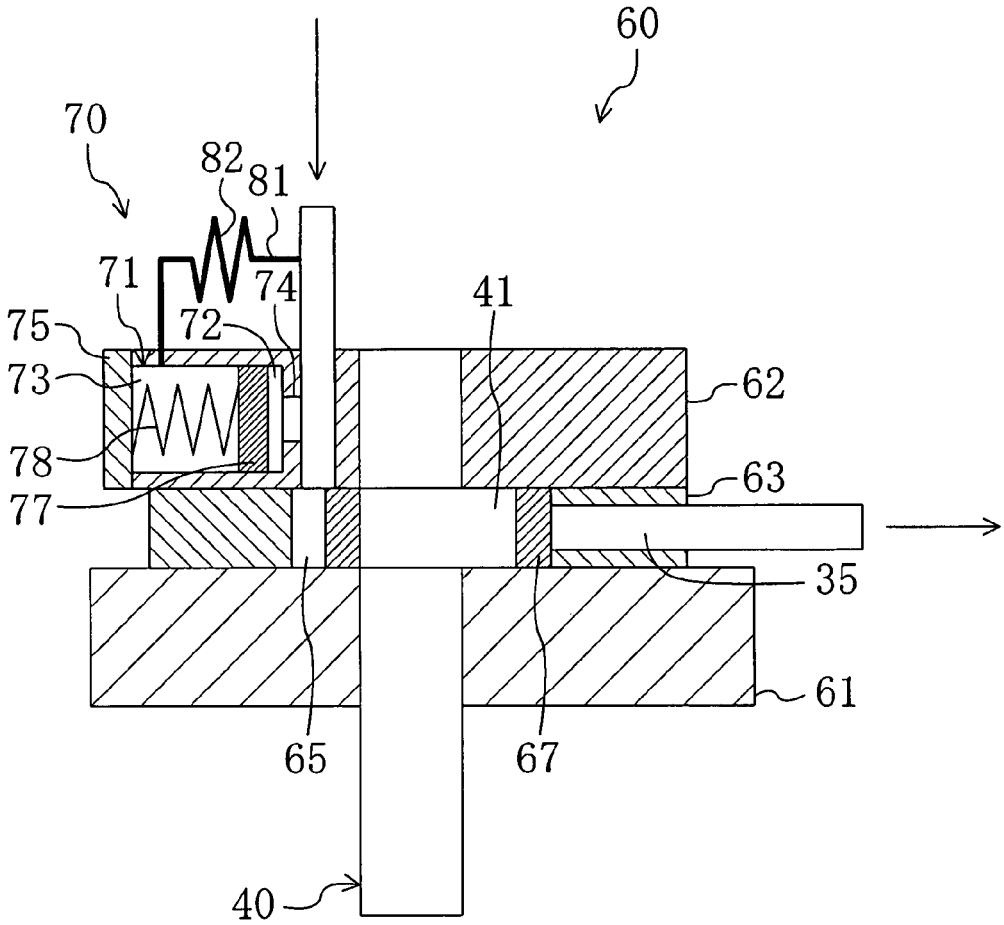
FIG. 9 is a longitudinal cross sectional view which shows a principal part of the expansion mechanism according to a second embodiment of the present invention.

Referring next to FIG. 9, a second embodiment of the present invention will be described below.

The second embodiment is a modification of the first embodiment in that the pressure snubbing means (70) is modified in configuration. In other words, unlike the first embodiment that makes utilization of discharge fluid from the compression mechanism (50) as a back pressure of the back pressure chamber (73), suction fluid in the inflow port (34) is utilized as a back pressure in the second embodiment.

More specifically, the pressure snubbing chamber (71) is provided, between itself and the inflow port (34), with a connecting pipe (81). One end of the connecting pipe (81) is connected upstream of the connecting position of the communicating passageway (74) in the inflow port (34) while the other end thereof is connected to the back pressure chamber (73) of the pressure snubbing chamber (71), and a capillary tube (82) is provided along the connecting pipe (81). In addition, the back pressure chamber (73) is completely blocked off from the internal space (S) of the casing (31) by the blocking lid (75).

In this case, the inflow/outflow chamber (72) is filled up with suction fluid in the inflow port (34) and is placed in the same pressure state as the suction fluid, as in the first embodiment. On the other hand, although the back pressure chamber (73) is also filled up with suction refrigerant in the inflow port (34), the back pressure chamber (73) is placed in a pressure state lower than the suction fluid by an amount corresponding to the frictional resistance of the capillary tube (82). And, in the pressure snubbing chamber (71), the pressure of the inflow/outflow chamber (72), the pressure of the back pressure chamber (73), and the frictional resistance force of the capillary tube (82) become balanced with each other through the piston (77) in the normal condition.

Here, for example, when the pressure of suction refrigerant in the inflow port (34) decreases, the pressure of the inflow/outflow chamber (72) decreases much below the pressure of the back pressure chamber (73) due to the frictional resistance of the capillary tube (82), and the balanced state between the chambers (72, 73) is broken. As a result, the piston (77) slidingly shifts towards the inflow/outflow chamber (72). As the piston (77) shifts, the volume of the inflow/outflow chamber (72) decreases, and an amount of refrigerant corresponding to the decreased volume is discharged into the inflow port (34) from the inflow/outflow chamber (72). Consequently, the drop in the pressure of suction fluid is reduced. At that time, although the volume of the back pressure chamber (73) increases, suction fluid in the inflow port (34) little flows into the back pressure chamber (73) because of the intervention of the capillary tube (82), and the pressure of the back pressure chamber (73) decreases to approach the balanced state.

In addition, when the pressure of the suction refrigerant increases, the pressure of the inflow/outflow chamber (72) increases much above the pressure of the back pressure chamber (73) due to the frictional resistance of the capillary tube (82), and the balanced state between the chambers (72, 73) is broken. As a result, the piston (77) slidingly shifts towards the back pressure chamber (73). As the piston (77) shifts, the volume of the inflow/outflow chamber (72) increases, and an amount of refrigerant corresponding to the increased volume is drawn into the inflow/outflow chamber (72) from the inflow port (34). Consequently, the rise in the pressure of suction fluid is reduced. At that time, although the volume of the back pressure chamber (73) decreases, refrigerant in the back pressure chamber (73) little flows into the inflow port (34) because of the intervention of the capillary tube (82), and the pressure of the back pressure chamber (73) increases to approach the balanced state.

In the way as described above, also in the second embodiment, the piston (77) causes the volume of the inflow/outflow chamber (72) to vary in response to variation in the pressure of suction refrigerant, whereby discharge of refrigerant into or suction of refrigerant from the inflow port (34) is performed. This therefore makes it possible to effectively inhibit variation in the pressure of suction refrigerant.

In addition, as the back pressure of the back pressure chamber (73), the suction pressure of the inflow port (34) is utilized, and there is no need to provide a separate back pressure means and suction pressure variation is effectively inhibited by an inexpensive and simple configuration, as in the first embodiment. Other configurations, operations, and working effects of the second embodiment are the same as the first embodiment.

Variation of the Second Embodiment

Figure 10:
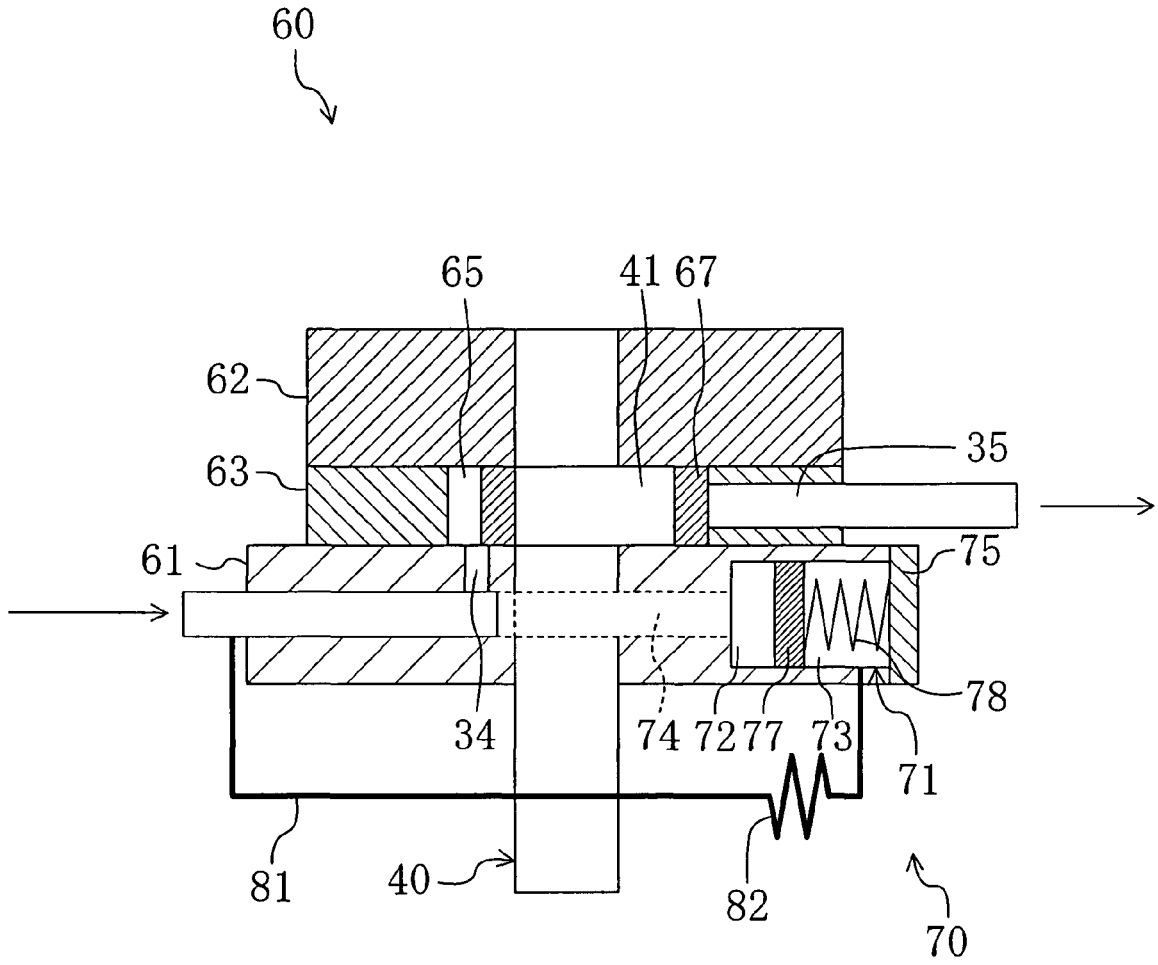
FIG. 10 is a longitudinal cross sectional view which shows a principal part of an expansion mechanism according to a variation of the second embodiment.

Referring now to FIG. 10, there is shown a variation of the second embodiment. Instead of the arrangement of the second embodiment in which the inflow port (34) and the pressure snubbing chamber (71) are formed in the rear head (62), both are formed in the front head (61) in the variation of the second embodiment. In other words, the inflow port (34) and the pressure snubbing chamber (71) are formed within the front head (61), as in the third variation of the first embodiment. Other configurations, operations, and working effects of the variation of the second embodiment are the same as the third variation of the first embodiment.

Third Embodiment of the Invention

Figure 11:
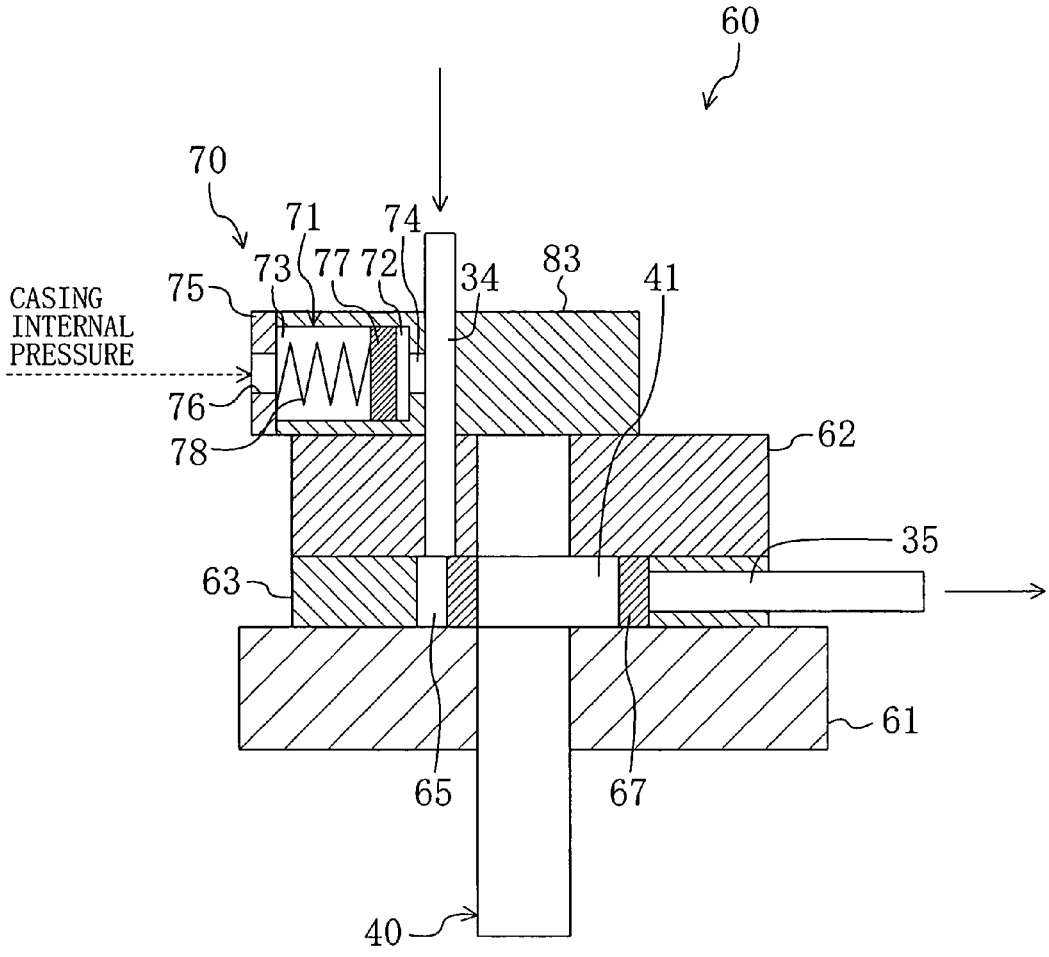
FIG. 11 is a longitudinal cross sectional view which shows a principal part of an expansion mechanism according to a third embodiment of the present invention.

In the following, a third embodiment of the present invention will be described with reference to FIG. 11.

Instead of the arrangement of the first embodiment in which the pressure snubbing chamber (71) is formed within the rear head (62), the pressure snubbing chamber (71) of the third embodiment is formed in an attachment member (83) which is supported by the rear head (62).

The attachment member (83) is shaped like a plate which is slightly smaller in size than the rear head (62). Being approximately centered on the inflow port (34), the attachment member (83) is mounted onto the upper end surface of the rear head (62). The inflow port (34) is formed such that it is vertically extended through the attachment member (83) and the rear head (62). And, the pressure snubbing chamber (71) is formed within the attachment member (83) in the same manner that it is formed in the rear head (62) in the first embodiment.

In this case, it is possible to mount the attachment member (83) to the expansion mechanism (60) by making utilization of the internal space (S) of the casing (31). Besides, pressure pulsation can be inhibited easily and effectively just by additional attachment of the attachment member (83) in which the pressure snubbing chamber (71) and the inflow port (34) are pre-formed, to the existing expander. Other configurations, operations, and working effects of the third embodiment are the same as the first embodiment.

In addition, in the third embodiment, the attachment member (83) is mounted onto the upper end surface of the rear head (62). Alternatively, the attachment member (83) may be mounted onto the lower end surface of the front head (61). In that case, the inflow port (34) is formed, as in the second variation of the first embodiment, in the front head (61).

Fourth Embodiment of the Invention

Figure 12:
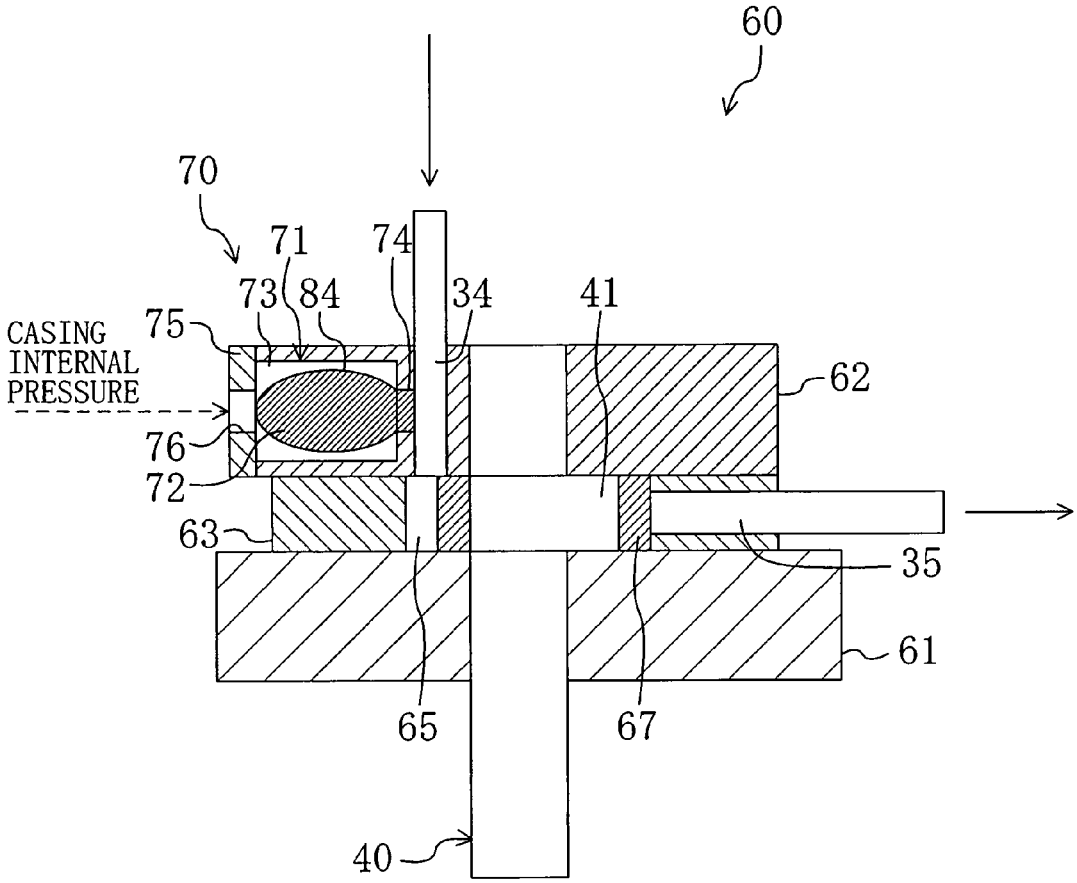
FIG. 12 is a longitudinal cross sectional view which shows a principal part of an expansion mechanism according to a fourth embodiment of the present invention.

In the following, a fourth embodiment of the present invention will be descried with reference to FIG. 12.

The fourth embodiment is a modification of the first embodiment in that the pressure snubbing chamber (71) is modified in configuration. In other words, instead of the piston (77) and the spring (78) in the first embodiment, a separation membrane (84) is employed in the fourth embodiment.

The separation membrane (84) is in the form of a balloon which is a deformable elastic body and is shaped into a vessel having an opening part. The separation membrane (84) is accommodated within the pressure snubbing chamber (71) and its opening part is connected to the communicating passageway (74). The pressure snubbing chamber (71) is divided by the separation membrane (84) into two chambers, i.e., the inflow/outflow chamber (72) and the back pressure chamber (73). Stated another way, in the pressure snubbing chamber (71), the internal space of the separation membrane (84) constitutes the inflow/outflow chamber (72) while on the other hand the space outside the separation membrane (84) constitutes the back pressure chamber (73). The inflow/outflow chamber (72) and the back pressure chamber (73) are filled up with suction refrigerant in the inflow port (34) and discharge refrigerant from the compression mechanism (50) respectively and are placed respectively in the same pressure sates as their refrigerants, as in the first embodiment.

Here, for example, when the pressure of suction refrigerant in the inflow port (34) decreases, the pressure of refrigerant in the inflow/outflow chamber (72) decreases below the pressure of refrigerant in the back pressure chamber (73), and the separation membrane (84) shrinks. As a result of such shrinkage, the volume of the separation membrane (84), i.e., the volume of the inflow/outflow chamber (72), decreases, and an amount of refrigerant corresponding to the decreased volume is discharged into the inflow port (34) from the inflow/outflow chamber (72). Consequently, the drop in the pressure of suction refrigerant in the inflow port (34) is reduced. In other words, the pressure snubbing chamber (71) provides a supply of pressure to the suction refrigerant. And the suction refrigerant in the inflow port (34), the inflow/outflow chamber (72), and the back pressure chamber (73) are pressure-balanced with each other and the separation membrane (84) expands up to its normal volume.

On the other hand, when the pressure of suction refrigerant in the inflow port (34) increases, the pressure of refrigerant in the inflow/outflow chamber (72) increases above the pressure of refrigerant in the back pressure chamber (73), and the separation membrane (84) expands. As a result of such expansion, the volume of the inflow/outflow chamber (72) increases, and an amount of refrigerant corresponding to the increased volume is drawn into the inflow/outflow chamber (72) from the inflow port (34). Consequently, the rise in the pressure of suction fluid in the inflow port (34) is reduced. In other words, the pressure snubbing chamber (71) absorbs pressure from the suction refrigerant. And the suction refrigerant in the inflow port (34), the inflow/outflow chamber (72), and the back pressure chamber (73) are pressure-balanced with each other and the separation membrane (84) shrinks down to its normal volume. In this way as described above, the separation membrane (84) is formed deformably such that the volume of the inflow/outflow chamber (72) is varied in response to pressure variation.

In addition, the separation membrane (84) produces elastic force by expansion and shrinkage, thereby enhancing expansion and shrinkage by its own elastic force. Accordingly, it becomes possible to perform expansion and shrinkage while flowing variation in the pressure without failing. As a result of this, pressure variation is inhibited more effectively. Other configurations, operations, and working effects of the fourth embodiment are the same as the first embodiment.

Fifth Embodiment of the Invention

Figure 13:
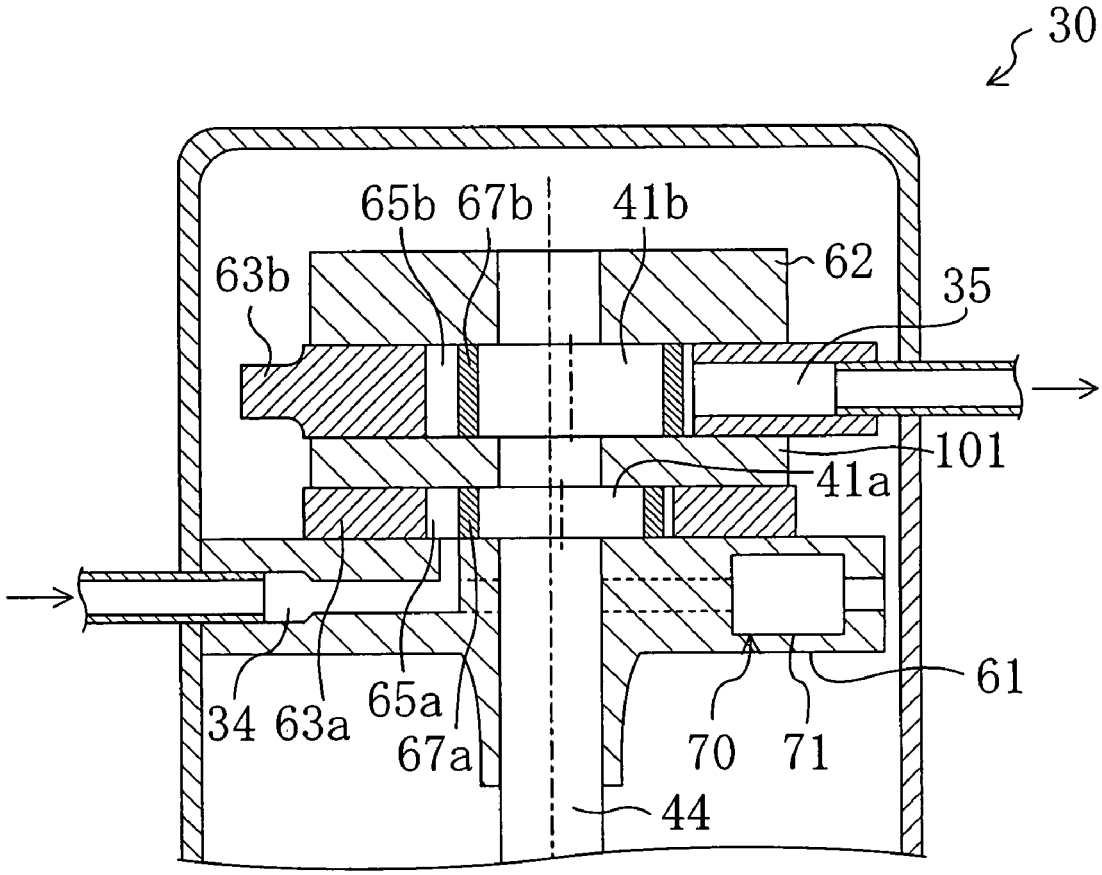
FIG. 13 is a longitudinal cross sectional view which shows a compression/expansion unit according to a fifth embodiment of the present invention.
Figure 14:
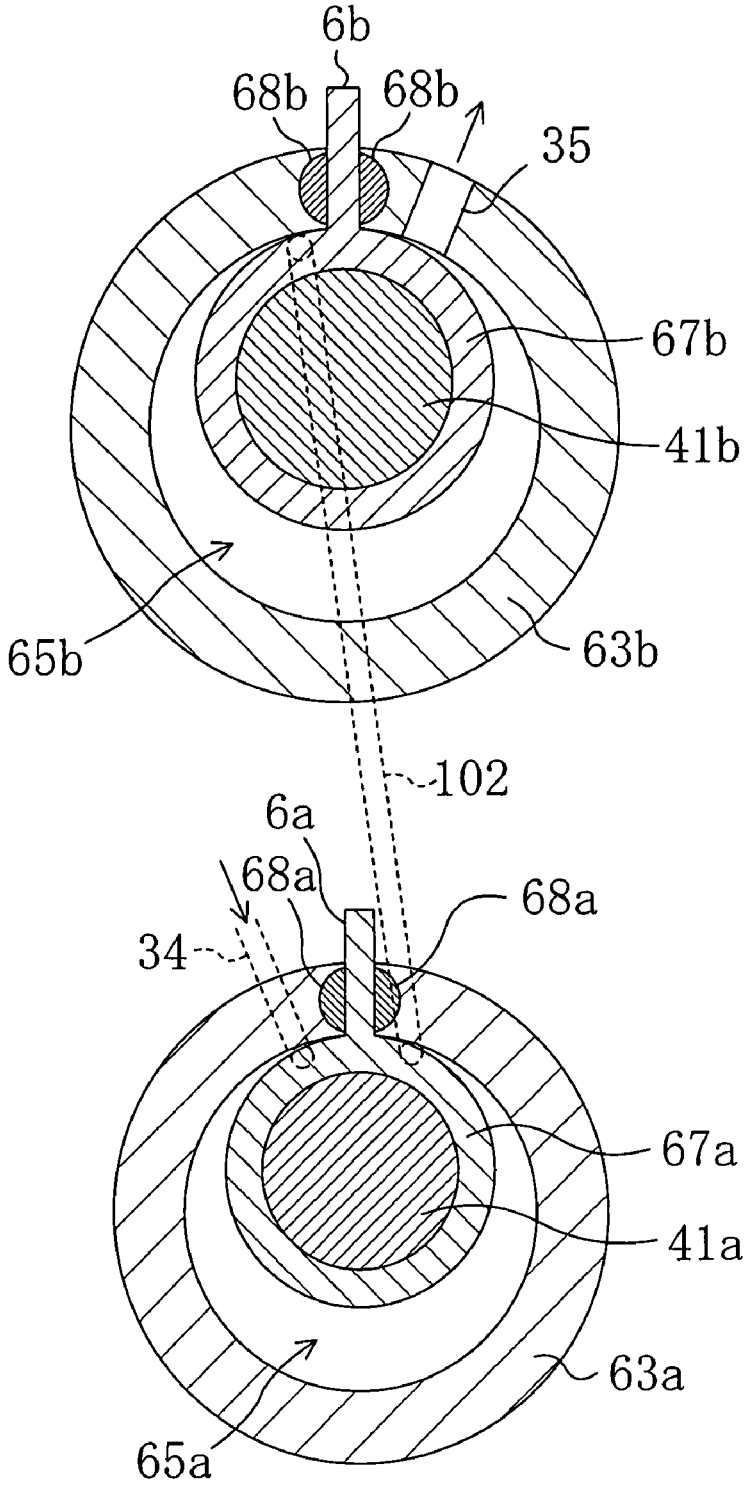
FIG. 14 is a transverse cross sectional view which shows a principal part of an expansion mechanism according to the fifth embodiment.

In the following, a fifth embodiment of the present invention will be described with reference to FIGS. 13 and 14.

The fifth embodiment is a modification of the first embodiment in that the expansion mechanism (60) is modified in configuration. In other words, instead of the arrangement of the first embodiment in which the expansion mechanism (60) is formed by a single-stage rotary expander, the expansion mechanism (60) of the fifth embodiment is formed by a two-stage rotary expander. Accordingly, the installation position of the pressure snubbing means (70) is changed. Here, the difference from the first embodiment in regard to the expansion mechanism (60) is described below.

The shaft (40) of the compression/expansion unit (30) is provided, at its upper end side, with two greater diameter eccentric parts (41*a*, 41*b*). These two greater diameter eccentric parts (41*a*, 41*b*) are formed such that they have a greater diameter than that of the main shaft part (44). Of the two greater diameter eccentric parts (41*a*, 41*b*), the lower one constitutes a first greater diameter eccentric part (41*a*) while the upper one constitutes a second greater diameter eccentric part (41*b*). Both the first greater diameter eccentric part (41*a*) and the second greater diameter eccentric part (41*b*) are off-centered in the same direction relative to the center of axle of the main shaft part (44). And, the second greater diameter eccentric part (41*b*) is greater than the first greater diameter eccentric part (41*a*) in the amount of eccentricity. In addition, the outside diameter of the second greater diameter eccentric part (41*b*) is greater than the outside diameter of the first greater diameter eccentric part (41*a*).

The expansion mechanism (60) is a two-stage, swinging piston type rotary expander. The expansion mechanism (60) has two cylinders (63*a*, 63*b*), two rotary pistons (67*a*, 67*b*), a front head (61), a rear head (62), and an intermediate plate (101). In the expansion mechanism (60), the front head (61), the first cylinder (63*a*), the intermediate plate (101), the second cylinder (63*b*), and the rear head (62) are arranged in layered fashion in a bottom-to-top order.

The first cylinder (63*a*) has lower and upper end surfaces the former of which is blocked by the front head (61) and the latter of which is blocked by the intermediate plate (101). The second cylinder (63*b*) has lower and upper end surfaces the former of which is blocked by the intermediate plate (101) and the latter of which is blocked by the rear head (62). The second cylinder (63*b*) has a greater inside diameter than that of the first cylinder (63*a*) and has a greater vertical thickness than that of the first cylinder (63*a*).

The shaft (40) is extended through the layered components, i.e., the front head (61), the first cylinder (63*a*), the intermediate plate (101), the second cylinder (63*b*), and the rear head (62). In addition, the first greater diameter eccentric part (41*a*) of the shaft (40) is located within the first cylinder (63*a*) while the second greater diameter eccentric part (41*b*) is located within the second cylinder (63*b*).

The first cylinder (63*a*) contains therein the first rotary piston (67*a*) and the second cylinder (63*b*) contains therein the second rotary piston (67*b*). Both of the two rotary pistons (67*a*, 67*b*) are shaped like a circular ring or cylinder. And, the first greater diameter eccentric part (41*a*) is rotatably engaged into the first rotary piston (67*a*) and the second greater diameter eccentric part (41*b*) is rotatably engaged into the second rotary piston (67*b*). In addition, the second rotary piston (67*b*) has a greater outside diameter than that of the first rotary piston (67*a*).

The first rotary piston (67*a*) is, at its outer peripheral surface, in sliding contact with the inner peripheral surface of the first cylinder (63*a*). In addition, the first rotary piston (67*a*) is, at its lower and upper end surfaces, in sliding contact with the front head (61) and with the intermediate plate (101), respectively. And, in the first cylinder (63*a*), a first expansion chamber (65*a*) is formed between the inner peripheral surface of the first cylinder (63*a*) and the outer peripheral surface of the first rotary piston (67*a*).

The second rotary piston (67*b*) is, at its outer peripheral surface, in sliding contact with the inner peripheral surface of the second cylinder (63*b*). In addition, the second rotary piston (67*b*) is, at its lower and upper end surfaces, in sliding contact with the intermediate plate (101) and with the rear head (62), respectively. And, in the second cylinder (63*b*), a second expansion chamber (65*b*) is formed between the inner peripheral surface of the second cylinder (63*b*) and the outer peripheral surface of the second rotary piston (67*b*).

The rotary piston (67*a*) is provided with a blade (6*a*) which is integral with the rotary piston (67*a*) and the rotary piston (67*b*) is provided with a blade (6*b*) which is integral with the rotary piston (67*b*). The blade (6*a*, 6*b*) is shaped like a plate which extends in the radial direction of the rotary piston (67*a*, 67*b*), and projects outwardly from the outer peripheral surface of the rotary piston (67*a*, 67*b*). And, the first expansion chamber (65*a*) within the first cylinder (63*a*) is divided by the first blade (6*a*) into a first high pressure chamber (103*a*) (high pressure side chamber) and a first low pressure chamber (104*a*) (low pressure side chamber). On the other hand, the second expansion chamber (65*b*) within the second cylinder (63*b*) is divided by the second blade (6*b*) into a second high pressure chamber (103*b*) (high pressure side chamber) and a second low pressure chamber (104*b*) (low pressure side chamber).

In addition, the cylinder (63*a*) is provided with a pair of bushes (68*a*, 68*a*) and the cylinder (63*b*) is provided with a pair of bushes (68*b*, 68*b*). Each bush (68*a*, 68*b*) is formed into an approximately crescentic shape having an inside surface which is a flat surface and an outside surface which is a circular arc surface, and is mounted, with the blade (6*a*, 6*b*) held therebetween. The inside surface of the bush (68*a*, 68*b*) slides, at its inside surface, against the blade (6*a*, 6*b*) while on the other hand the outside surface of the bush (68*a*, 68*b*) slides, at its outside surface, against the cylinder (63*a*, 63*b*). The blade (6*a*, 6*b*) is configured such that it is rotatably retractably supported by the cylinder (63*a*, 63*b*) through the bush (68*a*, 68*b*).

The expansion mechanism (60) is provided with an inflow port (34) formed in the front head (61) and an outflow port (35) formed in the second cylinder (63*b*). The inflow port (34) radially inwardly extends in the front head (61) and its terminating end is opened at the position in the inside surface of the front head (61) situated somewhat to the left-hand side of the bush (68*a*) in FIG. 14. That is to say, the inflow port (34) is in fluid communication with the first high pressure chamber (103*a*). On the other hand, the outflow port (35) radially extends through the second cylinder (63*b*) and its terminating end opens to the second low pressure chamber (104*b*) within the second cylinder (63*b*). And, the inflow and outflow ports (34, 35) constitute a suction passageway and a discharge passageway, respectively.

The intermediate plate (101) is provided with a communicating passageway (102) which is extended therethrough obliquely relative to the thickness direction. One end of the communicating passageway (102) which is an inlet side is opened at the position on the right-hand side of the first blade (6*a*) in the first cylinder (63*a*) while the other end thereof which is an outlet side is opened at the position on the left-hand side of the second blade (6*b*) in the second cylinder (63*b*). In other words, the communicating passageway (102) establishes fluid communication between the first low pressure chamber (104*a*) of the first expansion chamber (65*a*) and the second high pressure chamber (103*b*) of the second expansion chamber (65*b*).

In addition, the pressure snubbing means (70) which is a feature of the present invention is provided in the front head (61). In other words, the pressure snubbing chamber (71) is located opposite to the inflow port (34) in the front head (61) and is in fluid communication with the inflow port (34), as in the third variation of the first embodiment.

Operation of the Expansion Mechanism

Figure 15:
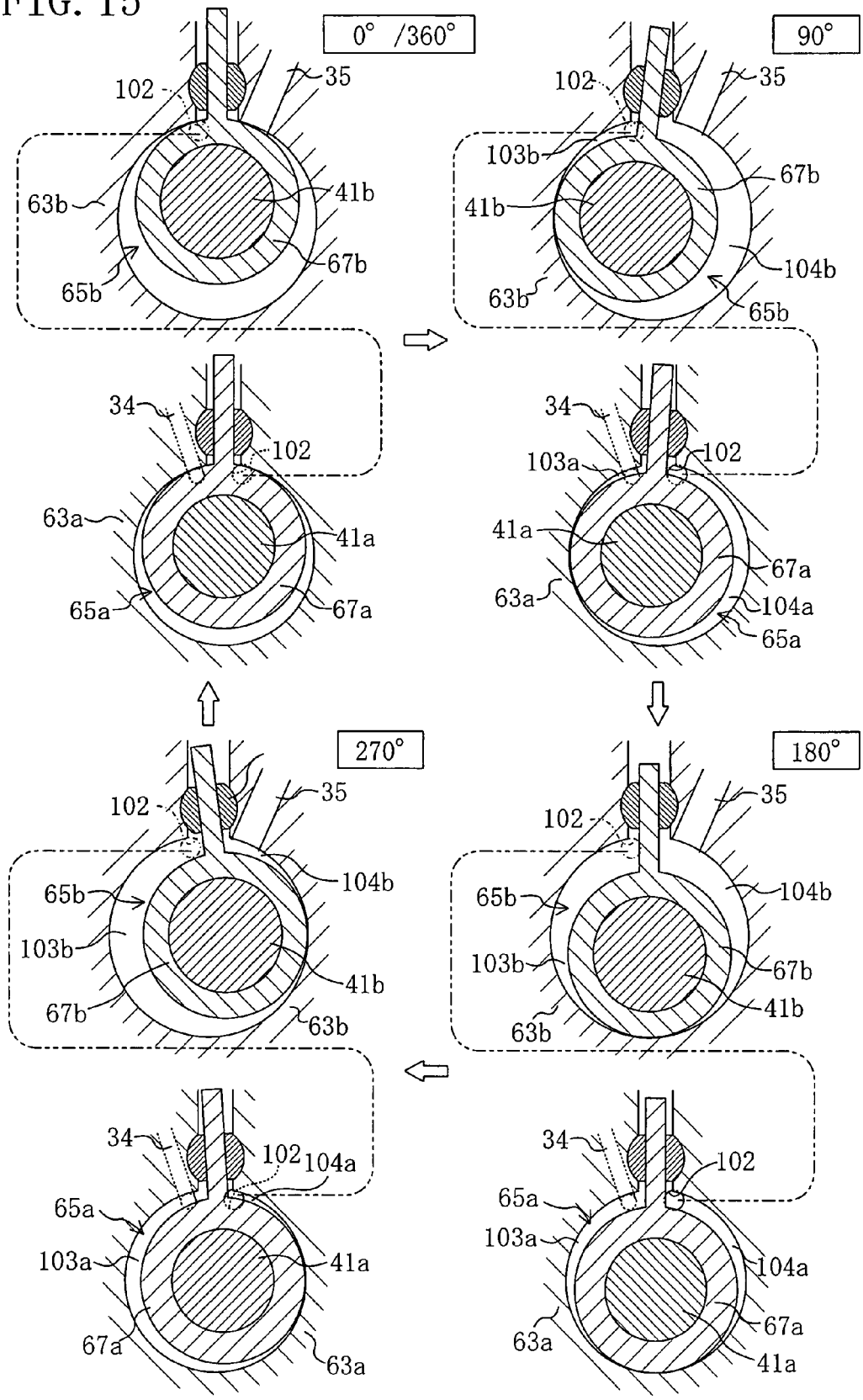
FIG. 15 is a transverse cross sectional view which illustrates operating states of the expansion mechanism according to the fifth embodiment.

In the following, the operation of the expansion mechanism (60) will be described with reference to FIG. 15.

In the first place, description will be made in regard to a first process in which high pressure refrigerant flows into the first high pressure chamber (103*a*) of the first cylinder (63*a*). When the shaft (40) makes a slight rotation from the rotation angle 0° state, the position of contact between the first rotary piston (67*a*) and the first cylinder (63*a*) passes through the inflow port (34), and high pressure refrigerant starts flowing into the first high pressure chamber (103*a*) from the inflow port (34). Thereafter, as the rotation angle of the shaft (40) gradually increases to 90 degrees, then to 180 degrees, and then to 270 degrees, the volume of the first high pressure chamber (103*a*) gradually increases, and high pressure refrigerant keeps flowing into the first high pressure chamber (103*a*). The inflowing of high pressure refrigerant into the first high pressure chamber (103*a*) continues until the rotation angle of the shaft (40) reaches 360 degrees.

Next, description will be made in regard to a second process in which refrigerant is caused to expand in the expansion mechanism (60). When the shaft (40) makes a slight rotation from the rotation angle 0° state, the first low pressure chamber (104*a*) and the second high pressure chamber (103*b*) become fluidly communicative with each other via the communicating passageway (102), and refrigerant starts flowing into the second high pressure chamber (103*b*) from the first low pressure chamber (104*a*). Thereafter, as the rotation angle of the shaft (40) gradually increases to 90 degrees, then to 180 degrees, and then to 270 degrees, the volume of the first low pressure chamber (104*a*) gradually decreases while simultaneously the volume of the second high pressure chamber (103*b*) gradually increases. Consequently, the total combined volume of the first low pressure chamber (104*a*) and the second high pressure chamber (103*b*) gradually increases. The total volume of the chambers (104*a*, 103*b*) continues to increase just before the rotation angle of the shaft (40) reaches 360 degrees. And, in the process during which the total volume of the chambers (104*a*, 103*b*) increases, refrigerant in each of the chambers (104*a*, 103*b*) is expanded. Such refrigerant expansion causes the shaft (40) to be rotationally driven.

In other words, refrigerant within the first low pressure chamber (104*a*) flows, through the communicating passageway (102), into the second high pressure chamber (103*b*) while it is expanding.

Next, description will be made in regard to a third process in which refrigerant is discharged out of the second low pressure chamber (104*b*) of the second cylinder (63*b*). The second low pressure chamber (104*b*) starts fluidly communicating with the outflow port (35) from the point of time when the shaft (40) is at a rotation angle of 0 degrees. Stated another way, the discharging of refrigerant into the outflow port (35) from the second low pressure chamber (104*b*) is started. This discharging of refrigerant is carried out over a period of time until the rotation angle of the shaft (40) reaches 360 degrees.

As described above, also for the case of the two-stage rotary expander, suction of refrigerant or discharge of refrigerant is determined by the rotation angle of the shaft (40). Although variation in the pressure of suction refrigerant (pressure pulsation) occurs in the inflow port (34), such pressure variation is effectively inhibited by means of the pressure snubbing chamber (71). Other configurations, operations, and working effects of the fifth embodiment are the same as the first embodiment.

Other Embodiments of the Invention

With respect to each of the above-described embodiments, the present invention may be arranged as follows.

For example, in each of the above-described embodiments, it is arranged such that discharge of refrigerant into or suction of refrigerant from the inflow port (34) is carried out by the provision of either the piston (77) or the separation membrane (84) in the pressure snubbing chamber (71). However, the present invention is not limited to such an arrangement. For example, any means may be employed as long as it is able to cause the volume of the inflow/outflow chamber (72) to vary in response to variation in the pressure.

In addition, the expansion mechanism (60) is formed by a rotary expander; however, the present invention may be applicable to the case where the expansion mechanism (60) is formed by a scroll expander or the like.

Furthermore, in each of the above-described embodiments, it is arranged such that either one of variation in the pressure of suction refrigerant and variation in the pressure of discharge refrigerant is inhibited. However, both of these pressure variations may be inhibited by the provision of the pressure snubbing means (70) in the inflow and outflow ports (34, 33).

In addition, in the embodiment in which the piston (77) is provided in the pressure snubbing chamber (71), the spring (78) may by omitted. The spring (78) may of course be mounted not in the back pressure chamber (73) but in the inflow/outflow chamber (72).

INDUSTRIAL APPLICABILITY

As has been described above, the present invention finds utility in the field of positive displacement expanders for producing power by the expansion of high pressure fluid.

What is claimed is:

1. A positive displacement expander having within a casing an expansion mechanism for generating power by the expansion of fluid in an expansion chamber, wherein:

the casing further contains therein pressure snubbing means for inhibiting at least either variation in the pressure of fluid which is drawn into the expansion chamber or variation in the pressure of fluid which is discharged out of the expansion chamber;

(a) the expansion mechanism is provided with a suction passageway for introducing fluid into the expansion chamber and a discharge passageway for discharging fluid after expansion from the expansion chamber; and (b) the pressure snubbing means is provided with a pressure snubbing chamber separated into a fluid inflow/outflow chamber in fluid communication with either the suction passageway or the discharge passageway, and a back pressure chamber by a partitioning member; and the pressure snubbing chamber is configured such that the partitioning member displaces to cause the volume of the inflow/outflow chamber to increase or decrease in response to fluid pressure pulsation of the suction passageway or the discharge passageway, thereby causing the inflow/outflow chamber to perform suction of fluid from and discharge of fluid into either the suction passageway or the discharge passageway.

2. The positive displacement expander of claim 1, wherein:

the pressure snubbing chamber of the pressure snubbing means is formed within a forming member of the expansion chamber.

3. The positive displacement expander of claim 1, wherein:

the pressure snubbing chamber of the pressure snubbing means is formed within an attachment member supported by a forming member of the expansion chamber.

4. The positive displacement expander of claim 2 or claim 3, wherein:

(a) a fluid compression mechanism is provided within the casing and an internal space (S) of the casing is filled up with fluid compressed by the compression mechanism; and (b) the pressure snubbing chamber comprises (i) a fluid inflow/outflow chamber in fluid communication with either the suction passageway or the discharge passageway, (ii) a back pressure chamber in fluid communication with the internal space (S) of the casing, and (iii) a partitioning member which separates the inflow/outflow chamber and the back pressure chamber and which is displaceably configured such that the volume of the inflow/outflow chamber varies in response to fluid pressure variation.

5. The positive displacement expander of claim 2 or claim 3, wherein:

the pressure snubbing chamber comprises (i) a fluid inflow/outflow chamber in fluid communication with either the suction passageway or the discharge passageway, (ii) a back pressure chamber which is connected to either the suction passageway or the discharge passageway by a connecting pipe having a capillary tube, and (iii) a partitioning member which separates the inflow/outflow chamber and the back pressure chamber and which is displaceably configured such that the volume of the inflow/outflow chamber varies in response to fluid pressure variation.

6. The positive displacement expander of claim 4, wherein:

the positive displacement expander is used in a refrigerant circuit in which refrigerant is circulated whereby a vapor compression refrigeration cycle is performed.

7. The positive displacement expander of claim 6, wherein:

the refrigerant is carbon dioxide.

* * * * *